US011411320B2

(12) United States Patent
Wang

(10) Patent No.: US 11,411,320 B2
(45) Date of Patent: Aug. 9, 2022

(54) ULTRA THIN AND COMPACT DUAL POLARIZED MICROSTRIP PATCH ANTENNA ARRAY WITH 3-DIMENSIONAL (3D) FEEDING NETWORK

(71) Applicant: NetComm Wireless Pty Ltd, Lane Cove (AU)

(72) Inventor: Daniel Wang, Lane Cove (AU)

(73) Assignee: NetComm Wireless Pty Ltd, Lane Cove (AU)

( * ) Notice: Subject to any disclaimer, the term of this patent is extended or adjusted under 35 U.S.C. 154(b) by 55 days.

(21) Appl. No.: 17/033,206

(22) Filed: Sep. 25, 2020

(65) Prior Publication Data

US 2021/0013623 A1 Jan. 14, 2021

Related U.S. Application Data

(63) Continuation of application No. PCT/AU2019/050244, filed on Mar. 20, 2019.

(30) Foreign Application Priority Data

Mar. 26, 2018 (AU) ..... 2018900994

(51) Int. Cl.
*H01Q 21/00* (2006.01)
*H01Q 1/48* (2006.01)
(Continued)

(52) U.S. Cl.
CPC ..... *H01Q 21/0075* (2013.01); *H01Q 1/48* (2013.01); *H01Q 9/0457* (2013.01); *H01Q 21/065* (2013.01); *H01Q 21/24* (2013.01)

(58) Field of Classification Search
CPC .. H01Q 21/065; H01Q 21/0075; H01Q 21/24; H01Q 9/0407
See application file for complete search history.

(56) References Cited

U.S. PATENT DOCUMENTS

| | | | | |
|---|---|---|---|---|
| 10,468,780 | B1 * | 11/2019 | Milroy | H01Q 1/42 |
| 2006/0139215 | A1 | 6/2006 | Heiniger | |
| 2016/0197404 | A1 | 7/2016 | Hashimoto et al. | |

FOREIGN PATENT DOCUMENTS

| | | | |
|---|---|---|---|
| CN | 105762508 | A | 7/2016 |
| EP | 2908380 | A1 | 8/2015 |
| KR | 20060059437 | A | 6/2006 |

OTHER PUBLICATIONS

Foster et al. ("Dual-frequency air-spaced patch antennas"; 2008 IEEE Antennas and Propagation Society International Symposium, Sep. 9, 2008) (Year: 2008).*

(Continued)

*Primary Examiner* — Ricardo I Magallanes
(74) *Attorney, Agent, or Firm* — Kilpatrick Townsend & Stockton LLP

(57) ABSTRACT

An antenna assembly for transmitting or receiving radio waves, comprising: at least one patch antenna element; a three-dimensional (3D) microstrip line feeding network configured to feed the at least one patch antenna element for operation in dual polarisation, the 3D microstrip line feeding network comprising an upper layer and a lower layer; and a ground plane; wherein a first air gap is provided between the at least one patch antenna element and the ground plane, a second air gap is provided between the upper layer of the 3D microstrip line feeding network and the ground plane, and a third air gap is provided between the lower layer of the 3D microstrip line feeding network and the ground plane.

20 Claims, 26 Drawing Sheets

(51) Int. Cl.

| | |
|---|---|
| ***H01Q 21/06*** | (2006.01) |
| ***H01Q 21/24*** | (2006.01) |
| ***H01Q 9/04*** | (2006.01) |

(56) References Cited

OTHER PUBLICATIONS

International Search Report and Written Opinion of the International Searching Authority mailed May 28, 2019 in International Patent Application No. PCT/AU2019/050244. 13 pages.
Written Opinion of the International Preliminary Examining Authority mailed Apr. 15, 2020 in International Patent Application No. PCT/AU2019/050244. 7 pages.
International Preliminary Report on Patentability mailed Jul. 23, 2020 in International Patent Application No. PCT/AU2019/050244. 18 pages.
Esteve, Robert Vilaltella; "High-Efficiency Dual-Polarized Patch Antenna Array with Common Waveguide Feed"; Diploma Thesis; Universität Stuttgart, Institut für Hochfrequenztechnik; 2013; 93 pages.
Ghorbani, K. et al.; "Dual Polarized Wide-Band Aperture Stacked Patch Antennas"; IEEE Transactions on Antennas and Propagation; Aug. 2004; Vol/52, No. 8; pp. 2171-2174.
Mishra, Prashant K. et al.; "An Array of Broadband Dual Polarized Electromagnetically Coupled Microstrip Antennas"; Progress In Electromagnetics Research C; 2013; vol. 44; pp. 211-223.
Extended European Search Report dated Nov. 29, 2021 in EP Patent Application No. 19777636.2. 10 pages.

* cited by examiner

ULTRA THIN AND COMPACT DUAL POLARIZED MICROSTRIP PATCH ANTENNA ARRAY WITH 3-DIMENSIONAL (3D) FEEDING NETWORK

CROSS-REFERENCES TO RELATED APPLICATIONS

This application is a continuation application of International Patent Application No. PCT/AU2019/050244 entitled "ULTRA THIN AND COMPACT DUAL POLARIZED MICROSTRIP PATCH ANTENNA ARRAY WITH 3-DIMENSIONAL (3D) FEEDING NETWORK," filed on Mar. 20, 2019, which claims priority to Australian Patent Application No. 2018900994, filed on Mar. 26, 2018, all of which are herein incorporated by reference in their entirety for all purposes.

FIELD OF THE INVENTION

The present invention relates to a dual polarized compact high gain patch antenna array having an ultra thin profile for a fixed wireless, cellular base station or indoor coverage application. The present invention provides a microstrip patch array antenna with 3-dimensional (3D) microstrip line feeding network to increase the array antenna gain by reducing the low side lobes, which is inexpensive to manufacture. In one example, the dual polarized compact high gain patch antenna array is a 2×2 Multiple In Multiple Out (MIMO) antenna. In another example, the dual polarized compact high gain patch antenna array is a 4×4 MIMO antenna or a N×N MIMO dual polarized high gain antenna array.

BACKGROUND OF THE INVENTION

Patch antennas have been used for compact high gain dual polarisation antenna arrays. There are four types of methods to feed the patch antenna element in a patch antenna: microstrip line feeding, coaxial probe feeding, slot aperture feeding and proximity or electromagnetic coupling feeding.

For a compact high gain antenna array with multiple patch elements, microstrip line feeding in 2-dimensions, for example, etched on a RF printed circuit board (PCB), a popular fabrication method to fabricate as it is primarily a conductive strip connecting to the patch elements. It can be considered an extension of the patch element.

The disadvantage of this feeding method for a microstrip antenna array is that increasing the RF PCB substrate thickness to increase the bandwidth causes surface wave and spurious feed radiation to increase. This limits the bandwidth and reduces the array antenna gain because of the increase of unwanted side lobes levels.

One solution is to replace the RF substrate with an air dielectric. This eliminates the surface wave for an improved radiation pattern. However, when a dielectric material, such as air, is placed between a patch element connected to a feeding strip line and a ground plane, the size of the patch element becomes larger and the width of strip line becomes wider, in order to maintain the same impedance matching. The impedance matching is based on a 50 Ohm characteristic impedance matching network. The wider the microstrip line is for a patch array antenna, the more insertion loss of the strip line and the higher level of side lobe level of the radiation pattern for the patch array antenna. Sometimes, the size of the patch element is too large and the strip line is too wide to prevent use of the microstrip antenna array, especially when the patch elements and the strip lines are at the same height and also if constrained by the maximum geometric profile or footprint allowable for the antenna array. For a fixed wireless product or indoor coverage product, such physical size constraints are common.

FIG. 4 of EP2908380A1 shows a typical dual polarized microstrip patch antenna with a 2-dimensional (2D) feeding network etched on a RF PCB. This feeding network layout is described at page 16. In this arrangement, the patch antenna element and feeding network are positioned on the same layer as the RF PCB and are connected to function as a dual polarized patch antenna array.

FIG. 3 of US20060139215 shows a feeding network layout of a typical dual polarized microstrip patch antenna with a 2D feeding network etched on a RF PCB. In this arrangement, the patch antenna element and feeding network are positioned on the same layer as the RF PCB and are connected to function as a dual polarized patch antenna array.

SUMMARY OF THE INVENTION

The inventive concept arises from a recognition that it is beneficial to reduce the width of the microstrip line, with an arbitrary characteristic impedance matching network at the same layer of patch antenna element, in a 3-dimensional (3D) feeding network using air as a dielectric, and to reduce the side lobes level and improve the gain of the array antenna. Also, reducing the width of microstrip line for a multiple patch element antenna array through a 3D microstrip line feeding network using air as a dielectric allows each patch antenna element and the upper layer of microstrip line in dual polarisation to electrically fit and physically fit into a compact array antenna footprint without deteriorating the isolation between two polarisations.

The present invention, in one aspect, comprises an antenna assembly for transmitting or receiving radio waves. The antenna assembly comprises at least one patch antenna element. The antenna assembly also comprises a three-dimensional (3D) microstrip line feeding network configured to feed the at least one patch antenna element for operation in dual polarisation, the 3D microstrip line feeding network comprising an upper layer and a lower layer. The antenna assembly also comprises a ground plane. A first air gap is provided between the at least one patch antenna element and the ground plane. A second air gap is provided between the upper layer of the 3D microstrip line feeding network and the ground plane. A third air gap is provided between the lower layer of the 3D microstrip line feeding network and the ground plane. The air gaps are related to the impedance matching when a ground plane is referenced.

The 3D microstrip line feeding network may further comprise at least one vertical matching impedance bridge connecting the upper layer to the lower layer, the at least one vertical matching impedance bridge is configured to operate as a transformer of the upper layer of the 3D microstrip line feeding network for reducing side lobe level (SLL).

The orientation of the vertical matching impedance bridge may be perpendicular to the ground plane.

The distance of the upper layer of the 3D microstrip line feeding network above the ground plane may be substantially equal to the height of the at least one patch antenna element.

The lower layer of the 3D microstrip line feeding network may be positioned between the upper layer and the ground plane.

The lower layer of the 3D microstrip line feeding network may be positioned at approximately the midpoint between the upper layer and the ground plane.

The at least one patch antenna element may have a rectangular shape.

The upper layer of the 3D microstrip line feeding network may comprise a consecutive series of smaller branching members configured to operate as a combiner.

The lower layer of the 3D microstrip line feeding network may have a rectangular shape with a length that is approximately equal to half the width of the at least one patch antenna element.

The lower layer of the 3D microstrip line feeding network may have a through-hole located at its distal end.

The ground plane may have a through-hole beneath the through-hole of the lower layer.

There may be two vertical matching impedance bridges.

The two vertical matching impedance bridges may be positioned near opposite sides of the ground plane.

The at least one vertical matching impedance bridge may have a length of about 20 mm for a quarter-wavelength of 3600 MHz.

The antenna assembly may further comprise a plurality of non-metallic rivets and hollow non-metallic spacers configured to secure the upper layer above the ground plane at a predetermined height, wherein the non-metallic spacers are positioned between the upper layer and the ground plane and the non-metallic rivets pass through through-holes in the upper layer, the non-metallic spacers and the ground plane.

The non-metallic rivets may be push-in rivets with a bevelled head. The diameter of the bevelled head is larger than the diameters of the through-holes in the 3D microstrip line feeding network and antenna elements. The flared legs of the rivets in their undeformed state may be have a nominal circumference less than the circumference of the hole through spacer.

The present invention, in another aspect, comprises a 3D microstrip line feeding network configured to feed at least one patch antenna element for operation in dual polarisation.

The 3D microstrip line feeding network comprises an upper layer. The 3D microstrip line feeding network also comprises a lower layer. The 3D microstrip line feeding network also comprises at least one vertical matching impedance bridge connecting the upper layer to the lower layer. The at least one vertical matching impedance bridge is configured to operate as a transformer of the upper layer of 3D microstrip line feeding network for reducing side lobe level (SLL).

The present invention, in another aspect, comprises an antenna assembly for transmitting or receiving radio waves. The antenna assembly comprises a three-dimensional (3D) microstrip line feeding network configured to feed at least one patch antenna element for operation in dual polarisation. The 3D microstrip line feeding network comprises an upper layer and a lower layer. The antenna assembly also comprises at least one vertical matching impedance bridge connecting the upper layer to the lower layer. The at least one vertical matching impedance bridge is configured to operate as a transformer of the upper layer of the 3D microstrip line feeding network for reducing side lobe level (SLL). The upper layer has a first predetermined geometric dimension determining a first characteristic impedance (Z1). The at least one vertical matching impedance bridge has a second predetermined geometric dimension determining a second characteristic impedance (Z2). The lower layer has a third predetermined geometric dimension determining a third characteristic impedance (Z3). The first characteristic impedance (Z1) multiplied by the third characteristic impedance (Z3) is equal to the square of the second characteristic impedance (Z2).

The antenna assembly may be a 2×2 Multiple In Multiple Out (MIMO) antenna or 4×4 Multiple In Multiple Out (MIMO) antenna.

Exemplary embodiments provide a dual polarized microstrip patch antenna array using air as a dielectric. The antenna array generally includes a ground plane, at least one patch antenna element secured above the ground plane and a 3D microstrip line feeding network having two layers. The upper layer of the 3D microstrip line feeding network is connected to each patch antenna element at +45° and −45°. The lower layer is located between the upper layer and the ground plane. There is a vertical impedance matching bridge connecting the top and lower layers of the 3D microstrip line feeding network.

The multiple patch antenna element array antenna provides a compact that increases the array antenna gain by reducing the side lobes levels by using a 3D microstrip line feeding network using air as a dielectric. The present invention provides an ultra thin profile, compact and inexpensive patch antenna array.

The operating frequency related to this invention is WiFi, Long-Term Evolution (LTE) or other LTE generation telecommunication standard.

Other advantages and features according to the invention will be apparent to those of ordinary skill upon reading this application.

BRIEF DESCRIPTION OF THE DRAWINGS

Embodiments of the invention will be described with respect to the figures, in which like reference numbers denote like elements and in which.

DETAILED DESCRIPTION OF THE INVENTION

Figure 1:
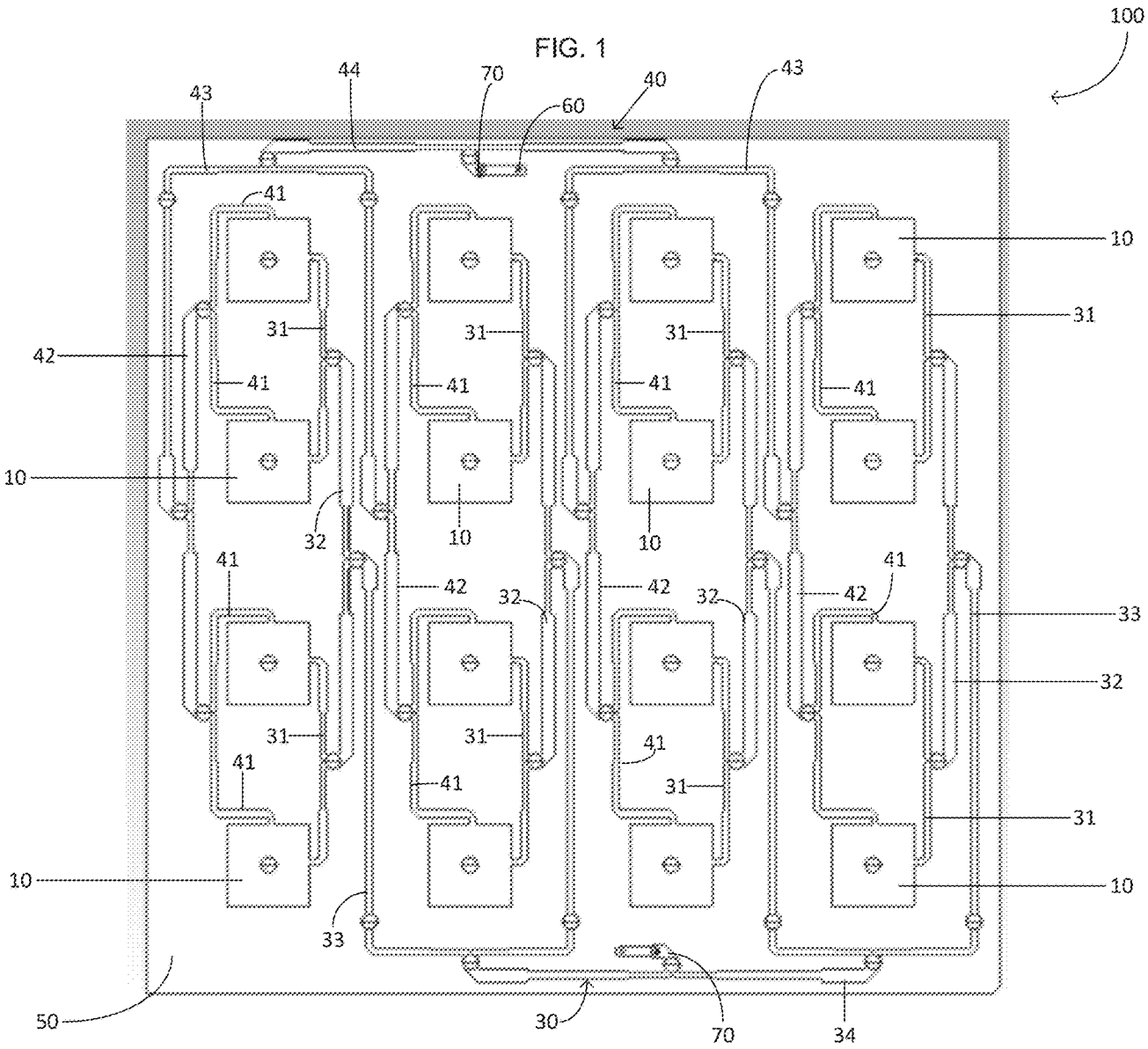
FIG. 1 is a top view of a 2×2 Multiple In Multiple Out (MIMO) antenna array in accordance with a preferred embodiment of the present invention.
Figure 2:
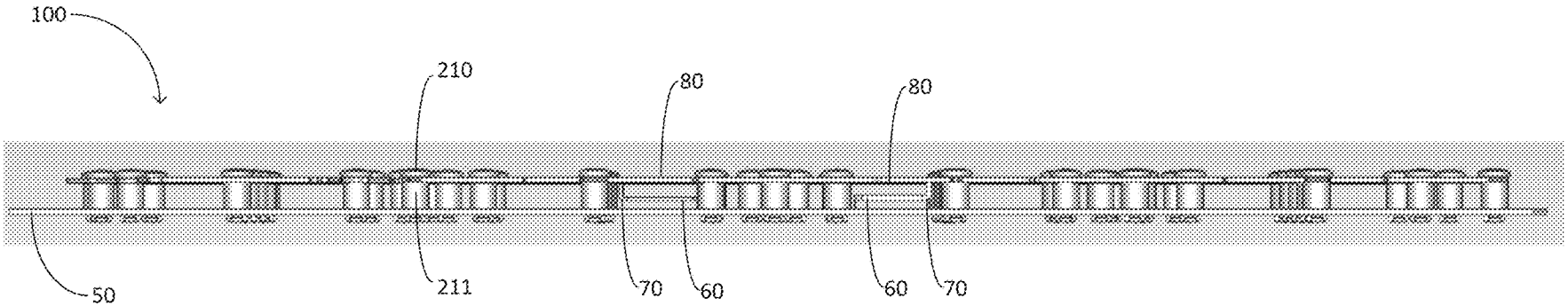
FIG. 2 is a side view of the antenna array of FIG. 1.

A preferred dual polarized directional array according to the present invention is illustrated in FIGS. 1 and 2 and shown generally at reference numeral 100.

The dual polarized directional array antenna 100 comprises a plurality of antenna elements 10 and a 3D microstrip line feeding network 30, 40 using air as a dielectric.

Figure 3:
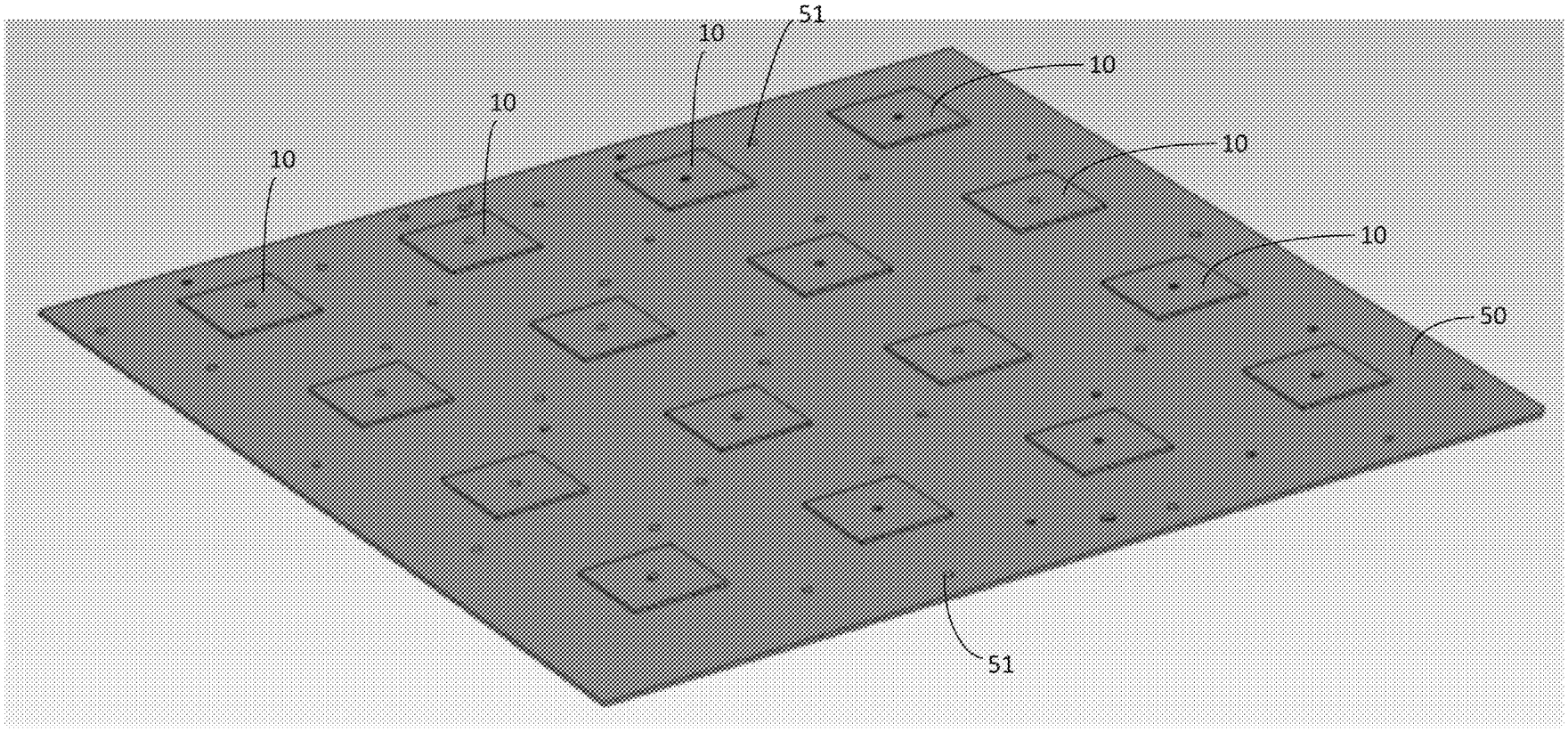
FIG. 3 is a perspective view from above showing multiple patch antenna elements and a ground plane of the antenna array of FIG. 1.
Figure 4:
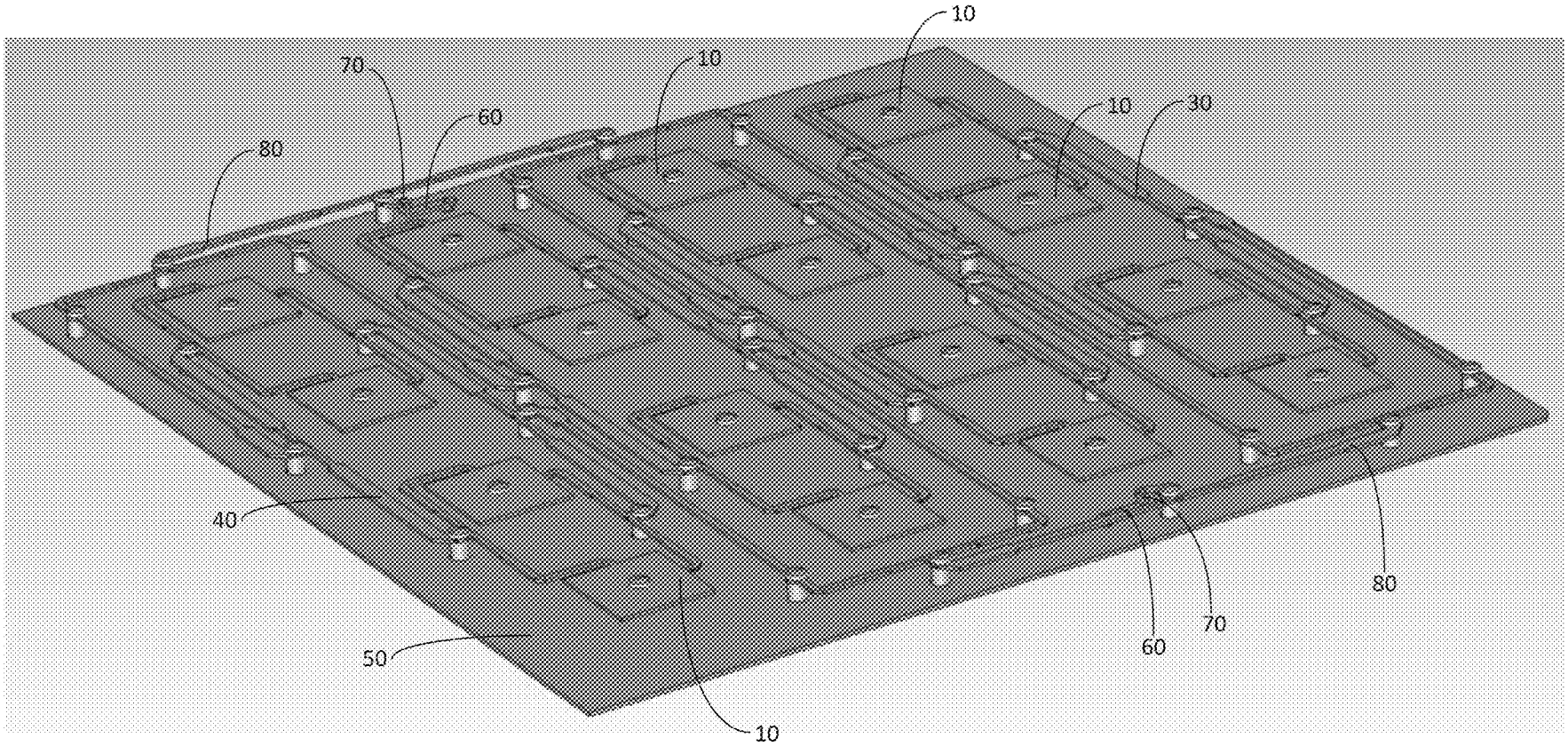
FIG. 4 is a perspective view from above of the antenna array of FIG. 1.
Figure 5:
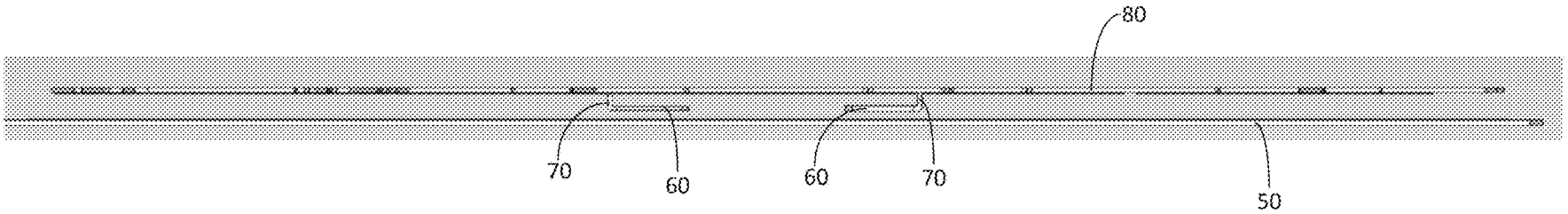
FIG. 5 is a side view of a 3D microstrip line feeding network and the ground plane of the antenna array of FIG. 1.

Referring to FIG. 3, a plurality of dual polarized patch antenna elements 10 and a ground plane 50 beneath the patch element 10 forms a patch element antenna array 100. There is a first air gap between the patch antenna element 10 and the ground plane 50. The air gap or air substrate functions as a dielectric. The antenna elements 10 are equally spaced apart from each other on the ground plane 50.

Referring to FIGS. 4, 5, 8 and 9, the 3D microstrip line feeding network 30, 40 helps the antenna 100 achieve very low side lobes and increase the antenna gain. The upper layer 80 of the 3D microstrip line feeding network 30, 40 provides a radiation pattern with low sidelobe levels which therefore increases the gain of the antenna array 100. There is an air gap between the 3D microstrip line feeding network 30, 40 from the ground plane 50.

The width of the upper layer 80 of the 3D microstrip line feeding network 30, 40 using air as a dielectric has a predetermined reduced width, for example, 2 mm, to help determine an arbitrary characteristic impedance for the matching network. A 2 mm width is a minimal microstrip line width that is manufacturable, from which a further arbitrary characteristic impedance for the matching network has been determined. This means the microstrip line impedance with 2 mm width is not directly referred to an arbitrary characteristic impedance for the matching network. Also positioning the upper layer 80 at the same height as the patch antenna elements 10 allows each patch antenna element 10 and the upper layer 80 in dual polarisation to fit into compact array antenna footprint electrically and physically well, without deteriorating the isolation between the two polarisations without degrading the isolation between two polarisations. For example, the physical dimensions of the compact array antenna is 340 mm×340 mm×8 mm. Each patch antenna element 10 is fed by a microstrip line feeding network in dual polarisation 30, 40.

The upper layer 80 of the 3D microstrip line feeding network 30, 40 is positioned to lie in the same plane as the height of the patch antenna element 10. In other words, the top surface of the upper layer 80 of the 3D microstrip line feeding network 30, 40 is in the same horizontal plane as the top surface of the patch antenna element 10. The lower layer 60 of the 3D microstrip line feeding network 30, 40 is positioned between the upper layer 80 and the ground plane 50. There is a second air gap provided between the upper layer 80 of the 3D microstrip line feeding network 30, 40 and the ground plane 50. There is a third air gap provided between the lower layer 60 of the 3D microstrip line feeding network 30, 40 and the ground plane 50. The air gaps are related to the impedance matching when a ground plane 50 is referenced. There is a vertical impedance matching bridge 70 between the upper layer 80 and the lower layer 60 of the 3D microstrip line feeding network 30, 40.

The upper layer 80 of each 3D microstrip line feeding network 30, 40 comprises a consecutive series of smaller branching members configured to operate as a combiner. Each polarization has a combiner. The microstrip line feeding network 30, 40 feeds the patch antenna elements 10 to form the dual polarized directional array antenna 100. The antenna 100 minimises the number of solder joints and eliminates RF energy losses otherwise arising from a connection between dissimilar metals. Each microstrip line 30, 40 has a consecutive series of smaller branching C-shaped members 31, 32, 33, 34, 41, 42, 43, 44 to efficiently use most of the surface area of the ground plane 50. In the preferred embodiment, each microstrip feed line 30, 40 has at least two C-shaped branches 34, 44. In a preferred embodiment, the microstrip feed lines 30, 40 are substantially identical and are arranged in an opposing spaced apart relationship to each other. There are four (4) stages of a combiner for each microstrip line 30, 40. The typical combining of the microstrip line 30 is there are eight (8) first-stage combiners 31 where each first-stage combiner 31 is connected to antenna elements 10 in co-polarization and the second-stage combiner 32 respectively. There are four (4) second-stage combiners 32 where each second-stage combiner 32 is connected to both a first-stage combiner 31 and a third-stage combiner 33. There are two (2) third-stage combiners 33 where each third-stage combiner 33 is connected to both a second-stage combiner 32 and a fourth-stage combiner 34 to deliver a wideband combiner 30. A similar wideband combining also applies for the other microstrip line 40. The microstrip lines 30, 40 of a combiner are designed in cascade ultra-wideband.

The two layers 60, 80 of the 3D microstrip line feeding network 30, 40 and the two vertical impedance matching bridges 70 form a wideband cascade matching network in 3 dimensions (horizontal and vertical). The layout of the upper layer 80 of the 3D microstrip line feed network 30, 40 and multiple patch antenna elements 10 enables it to fit into a compact antenna footprint electrically and physically well, without deteriorating the isolation between two polarisations. The multiple patch antenna elements 10 and the two layers 60, 80 of the 3D microstrip feeding network provide a compact and ultra thin profile antenna array 100.

Figure 12:
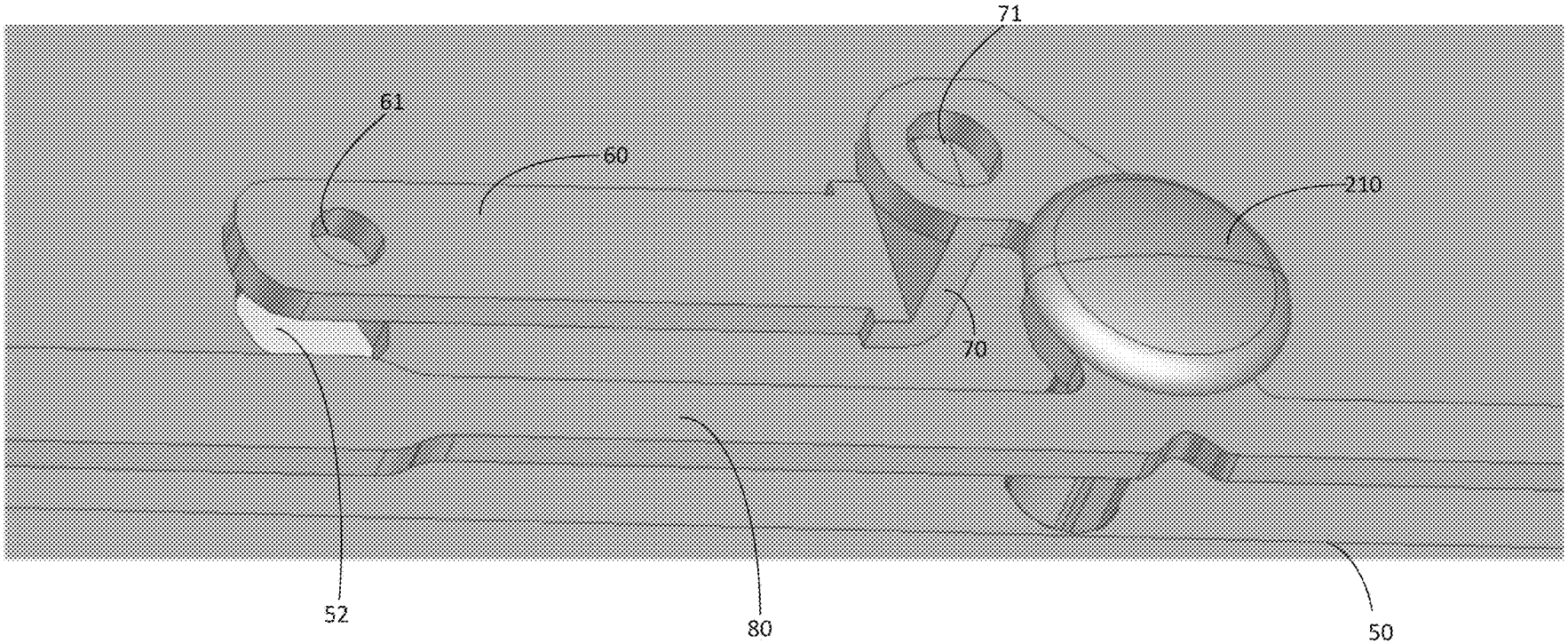
FIG. 12 is a zoomed in view at a third angle of the vertical impedance matching bridge of FIG. 8.
Figure 13:
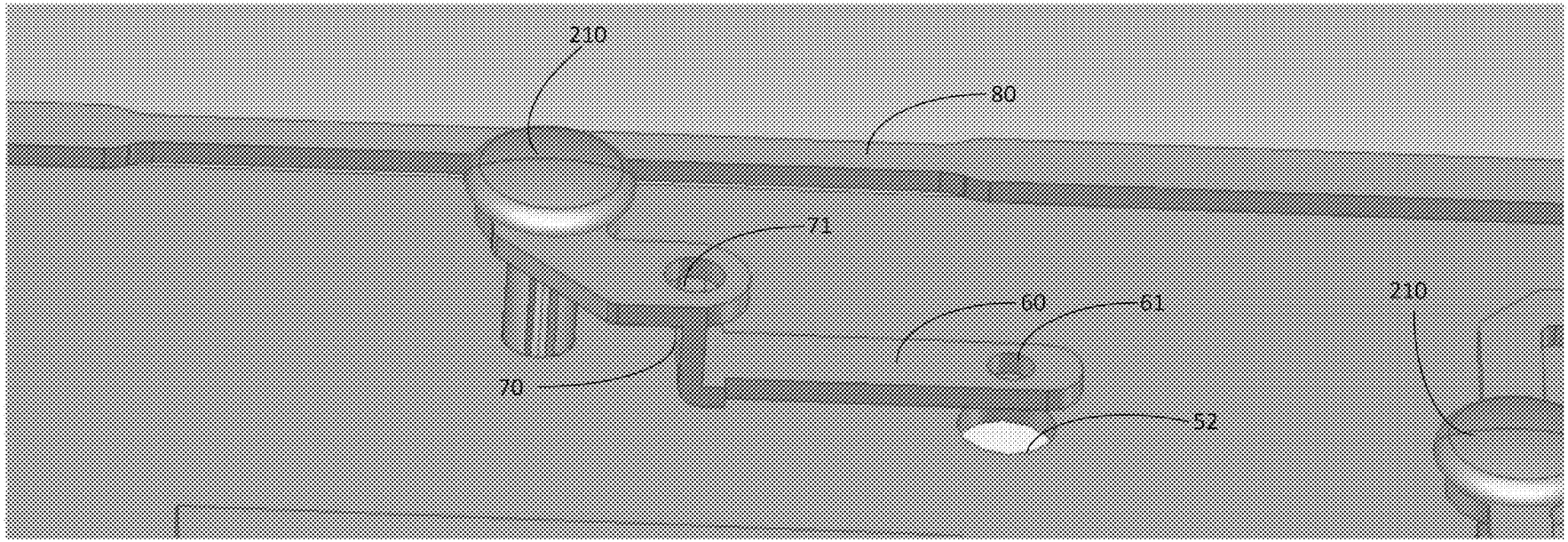
FIG. 13 is a zoomed in view at a fourth angle of the vertical impedance matching bridge of FIG. 8.

Turning to FIG. 12, the lower layer 60 of the 3D microstrip line feeding network 30, 40 has a through-hole 61 located at its distal end. The ground plane 50 has a through-hole 52 beneath the through-hole 61 of the lower layer 60. The through-holes 52, 61 enables a wire or cable to be passed through and soldered to the lower layer 60.

Figure 6:
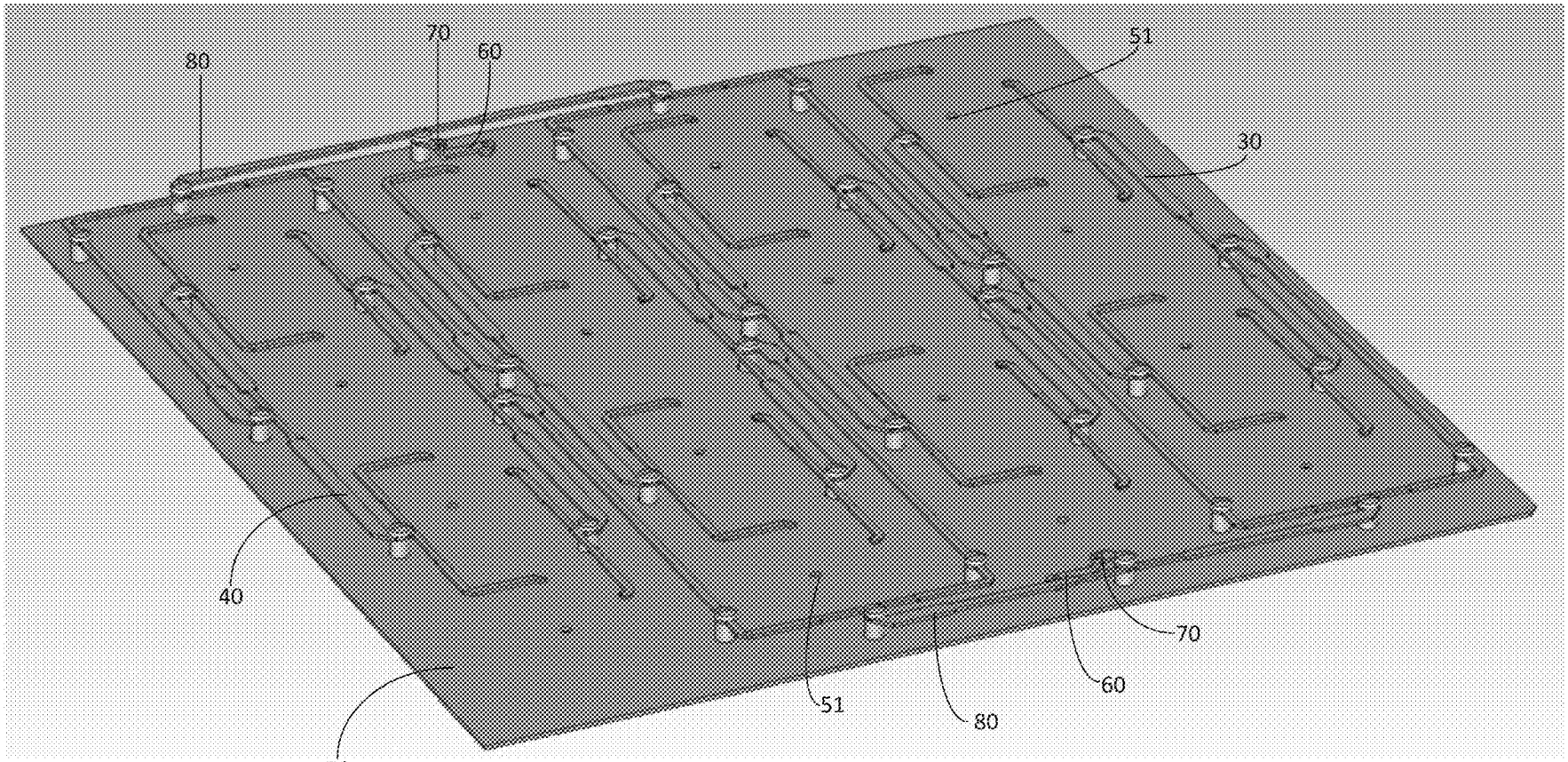
FIG. 6 is a perspective view from above of the 3D microstrip line feeding network positioned above the ground plane.
Figure 7:
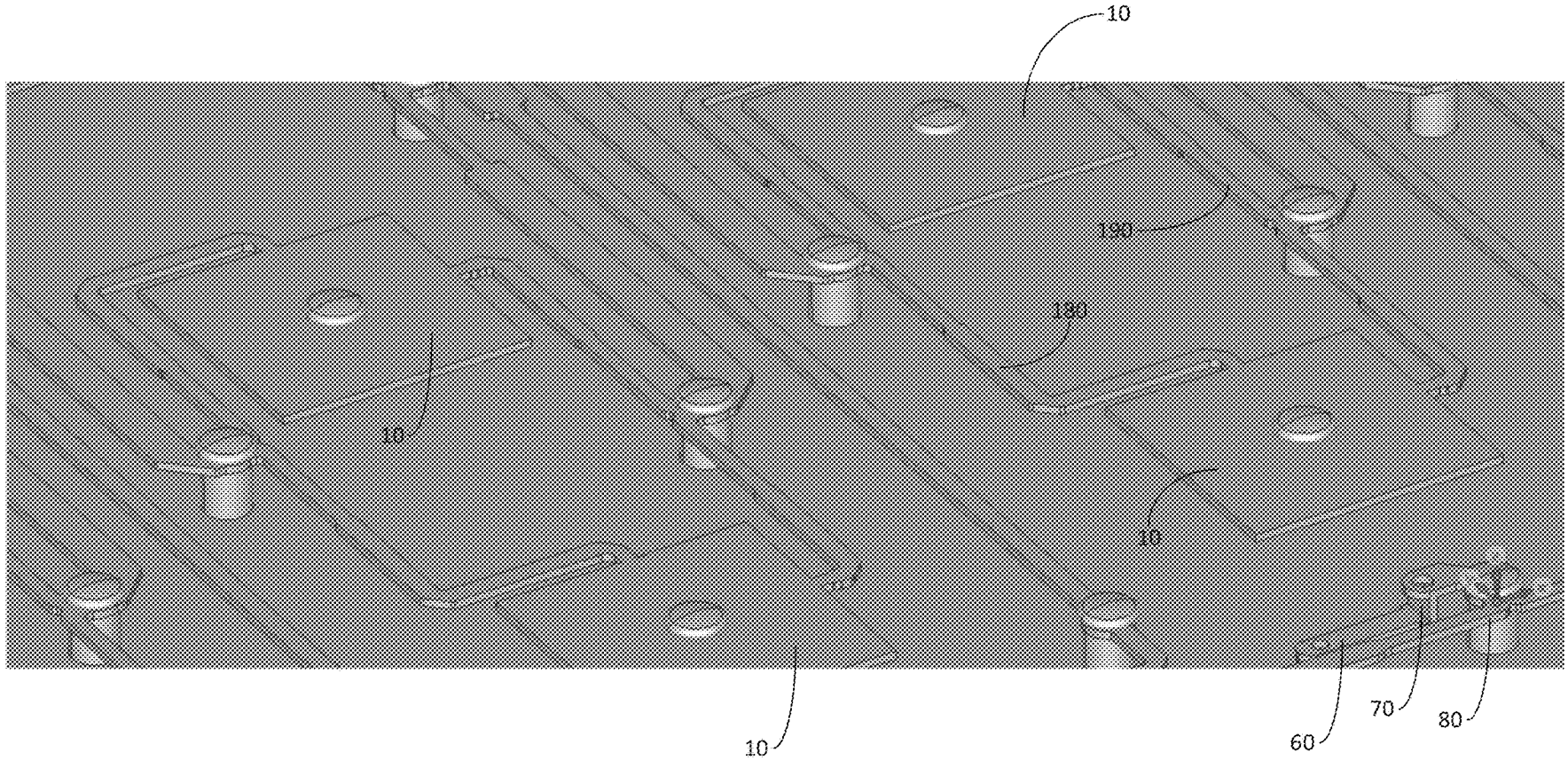
FIG. 7 is a zoomed in view of an upper layer of the 3D microstrip line feeding network.
Figure 8:
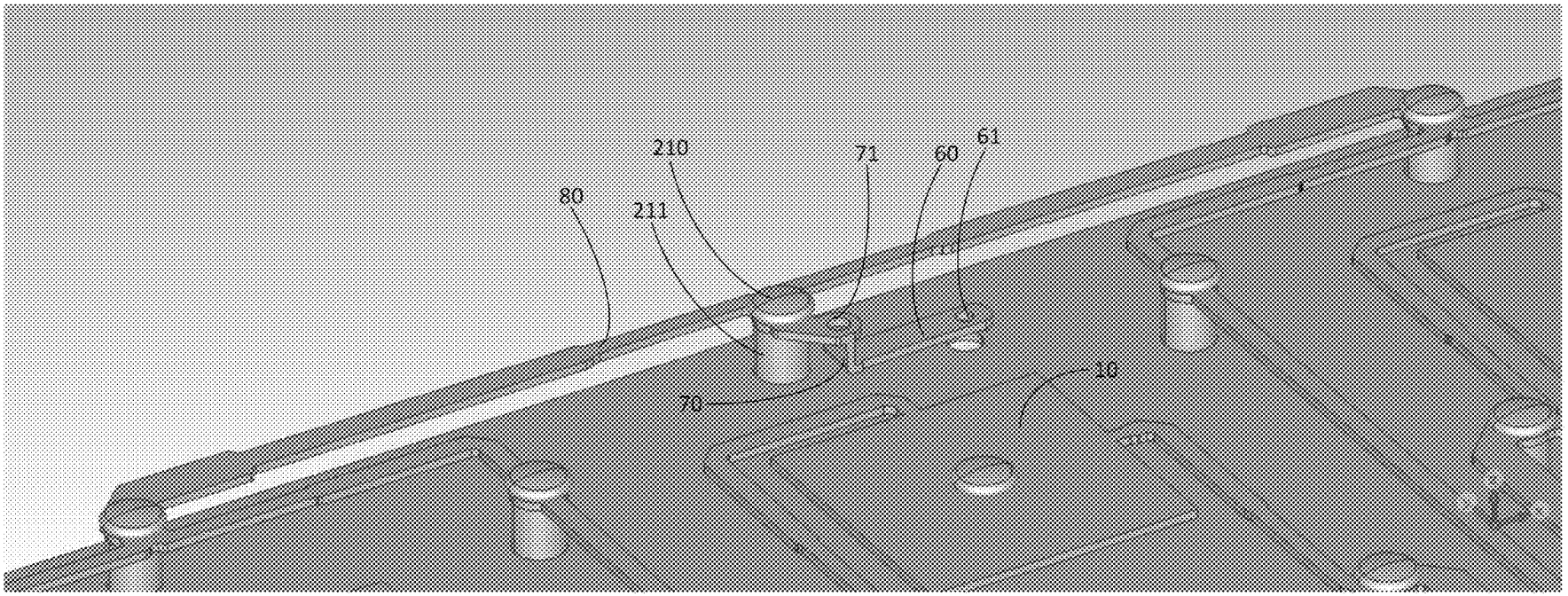
FIG. 8 is a perspective view from above showing a vertical impedance matching bridge connected to the upper layer and the lower layer of the 3D microstrip feeding network.
Figure 9:
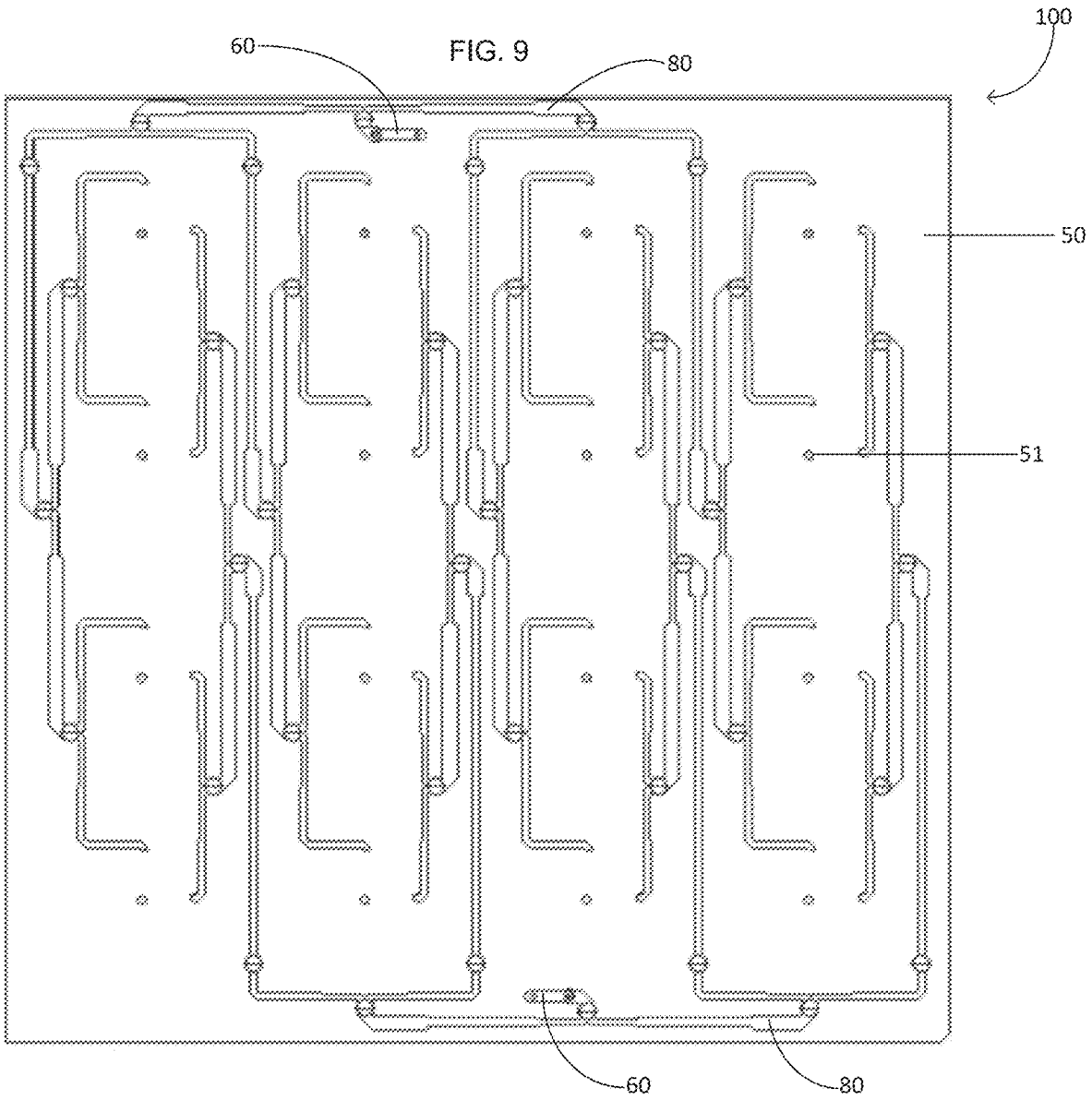
FIG. 9 is a top view of the 3D microstrip line feeding network and the ground plane without the patch antenna elements shown.
Figure 10:
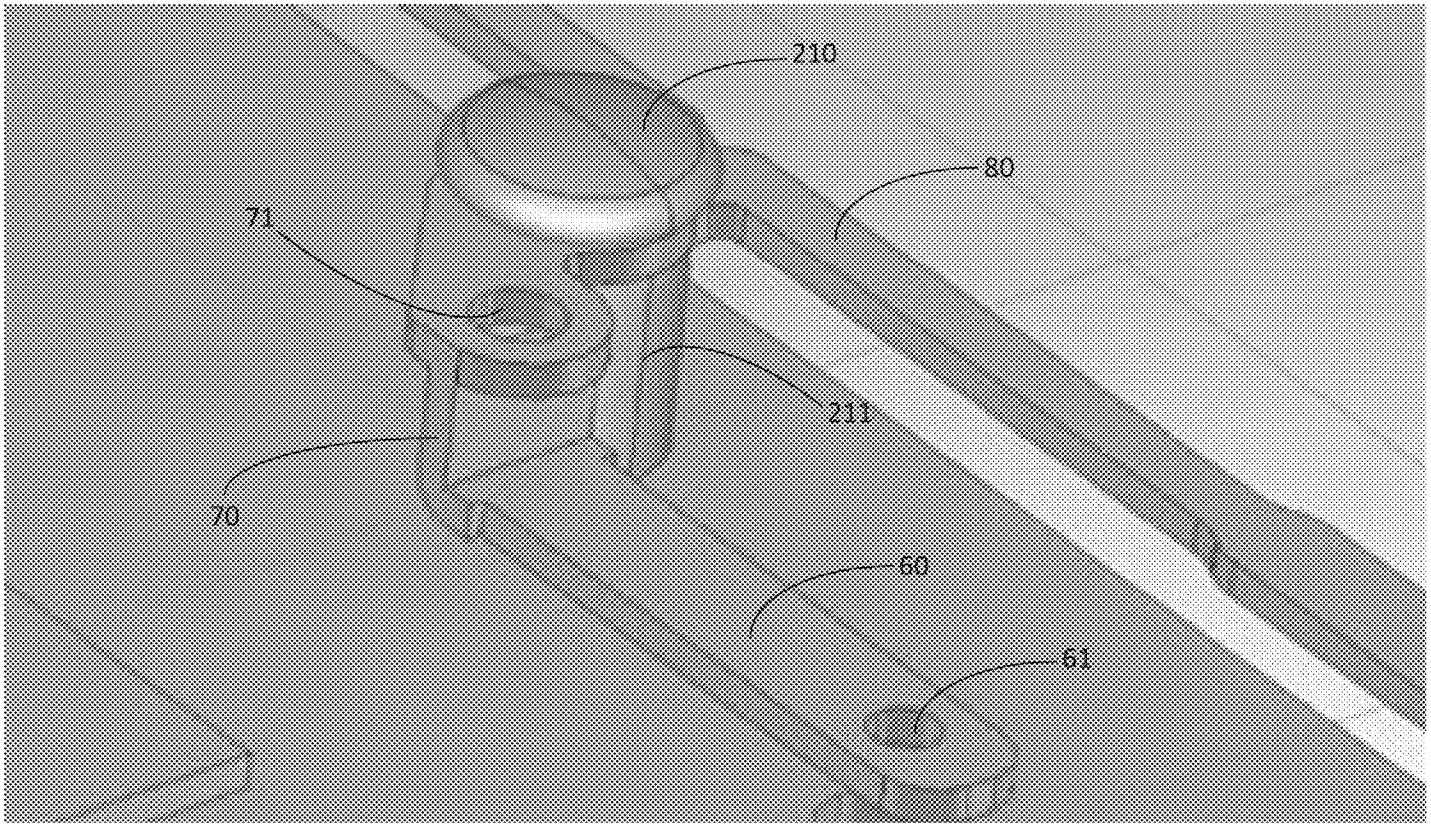
FIG. 10 is a zoomed in view of the vertical impedance matching bridge of FIG. 8.
Figure 11:
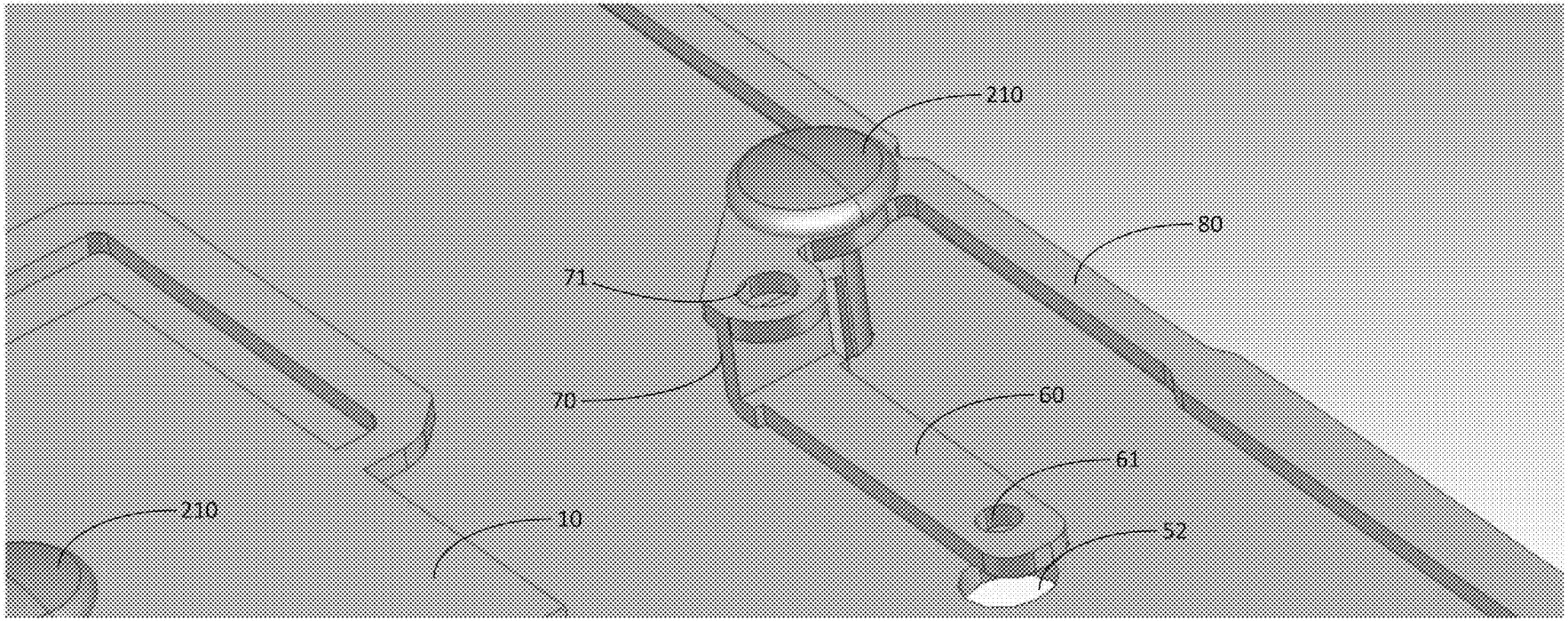
FIG. 11 is a zoomed in view at a second angle of the vertical impedance matching bridge of FIG. 8.
Figure 17:
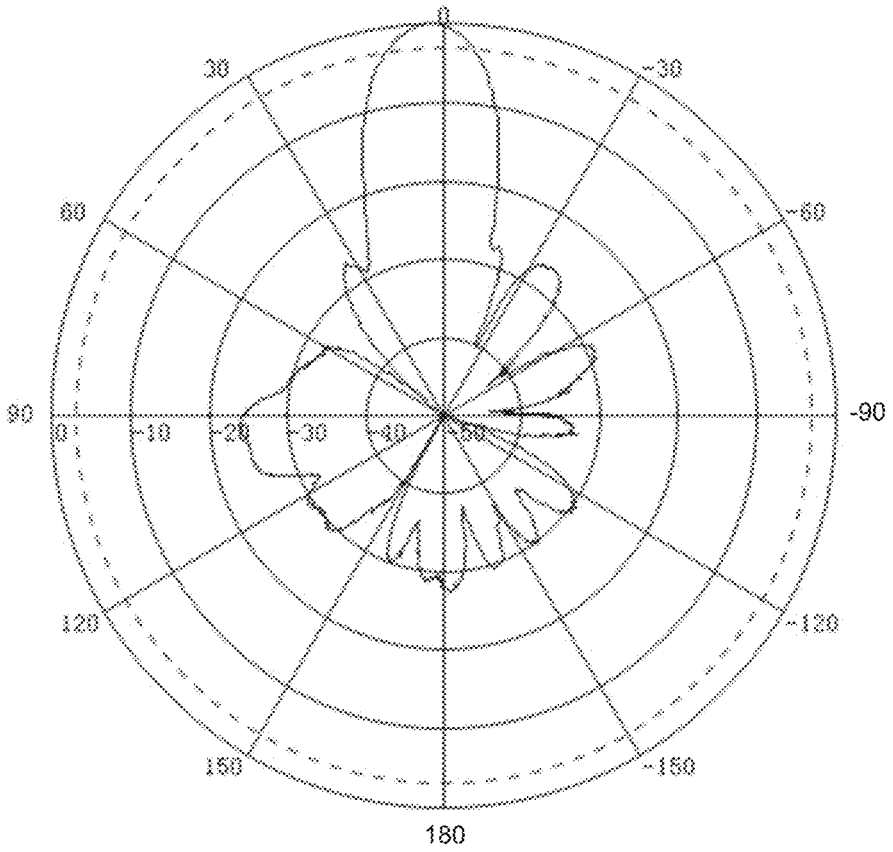
FIG. 17 is a diagram depicting the improved radiation pattern at 3400 MHz of the antenna array of FIG. 1.
Figure 18:
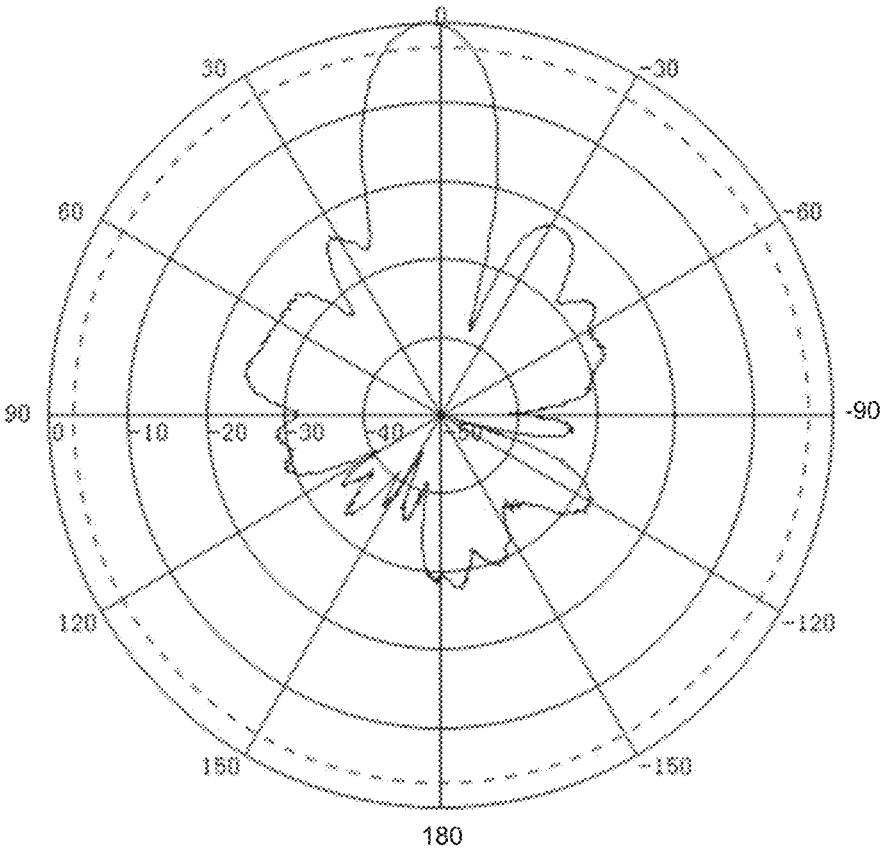
FIG. 18 is a diagram depicting the improved radiation pattern at 3500 MHz of the antenna array of FIG. 1.
Figure 19:
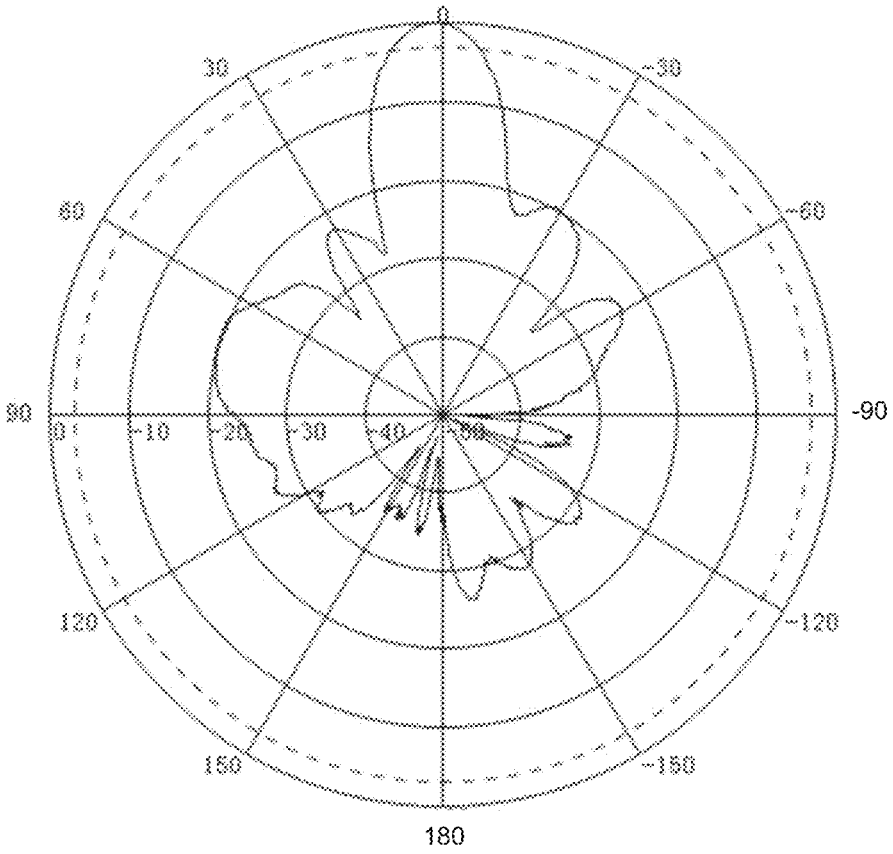
FIG. 19 is a diagram depicting the improved radiation pattern at 3600 MHz of the antenna array of FIG. 1.
Figure 20:
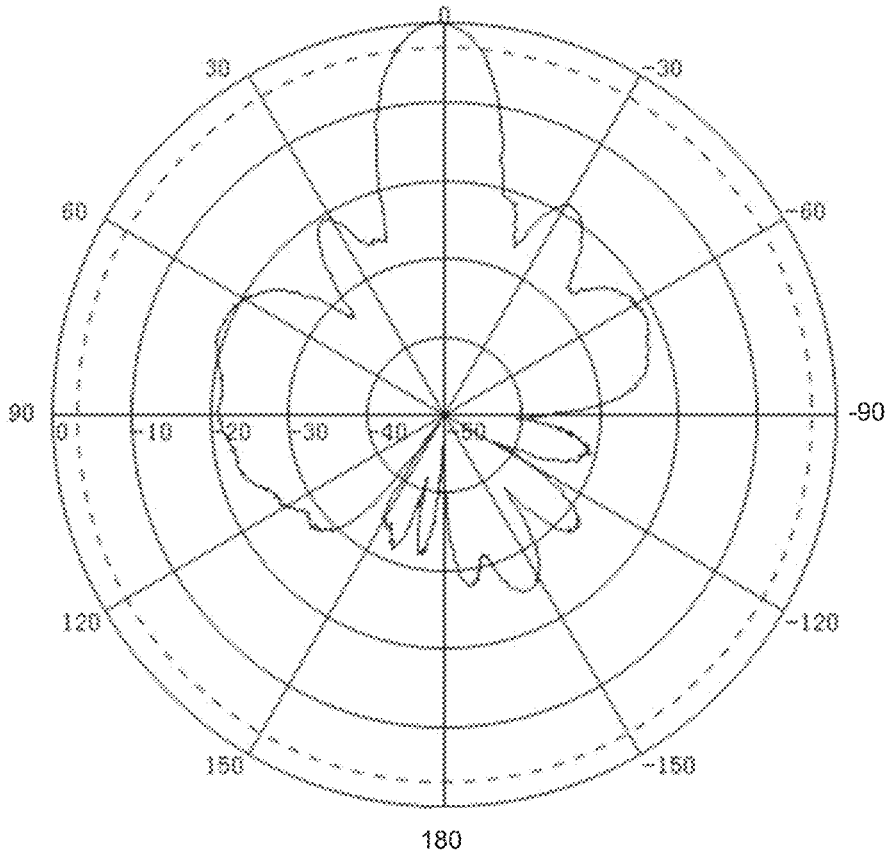
FIG. 20 is a diagram depicting the improved radiation pattern at 3700 MHz of the antenna array of FIG. 1.
Figure 21:
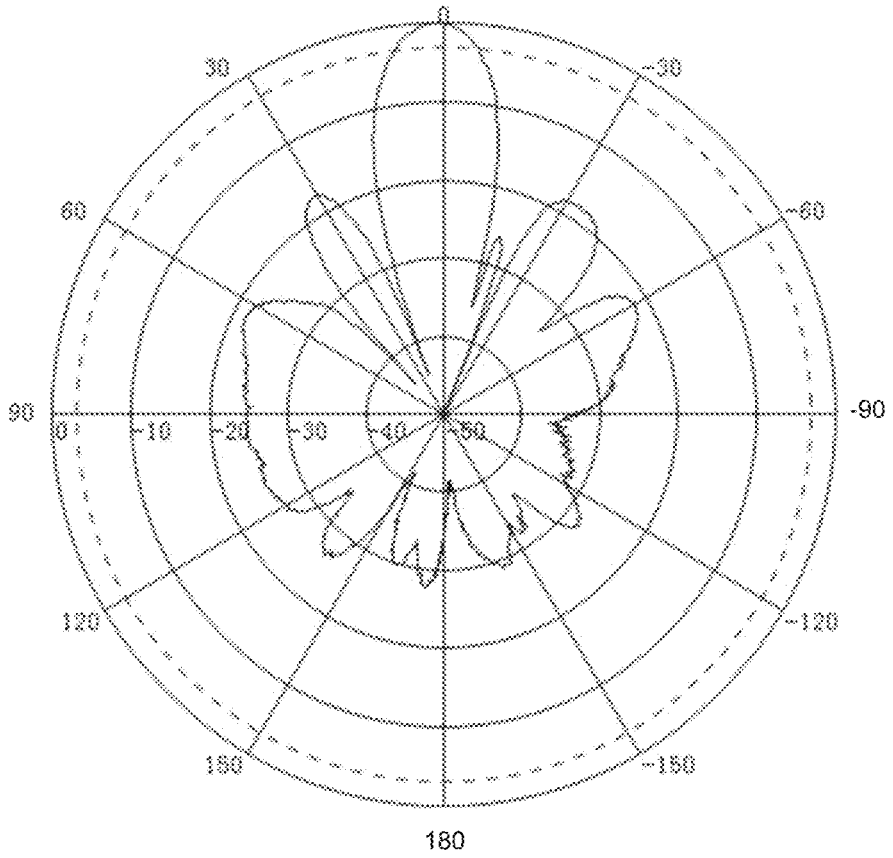
FIG. 21 is a diagram depicting the improved radiation pattern at 3800 MHz of the antenna array of FIG. 1.
Figure 22:
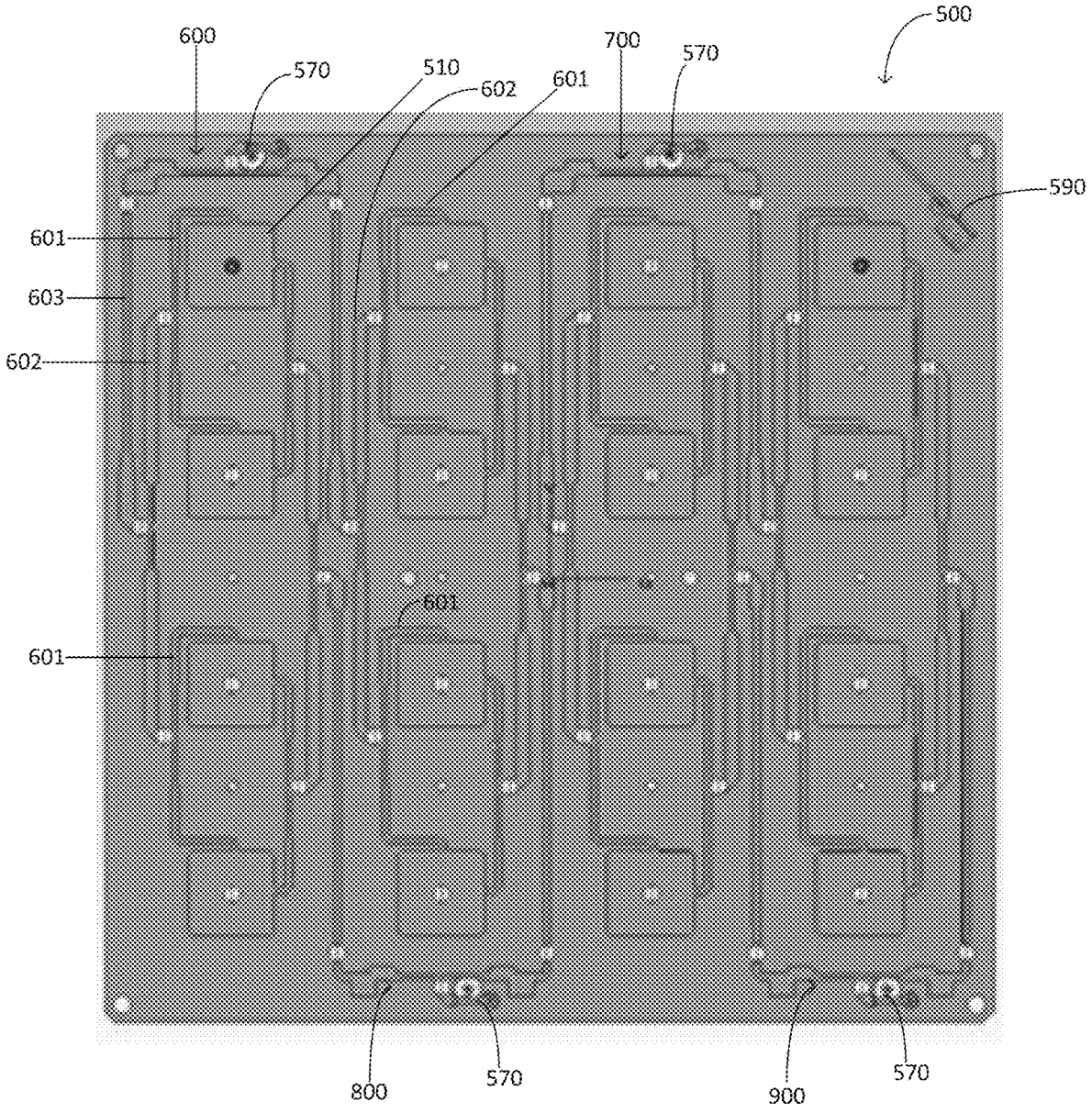
FIG. 22 is a top view of a 4×4 Multiple In Multiple Out (MIMO) antenna array.
Figure 23:
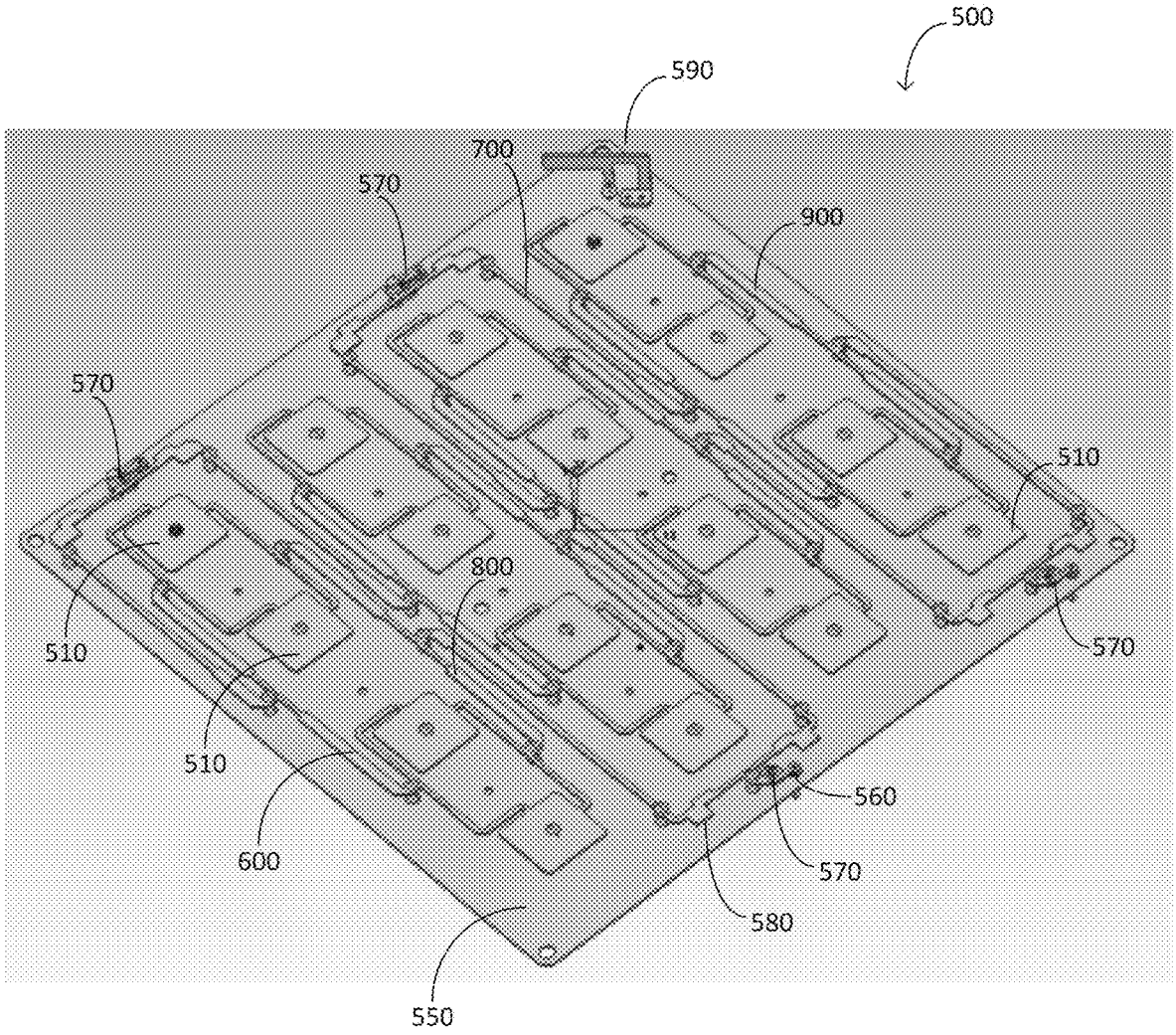
FIG. 23 is a perspective top view of the antenna array of FIG. 22.
Figure 24:
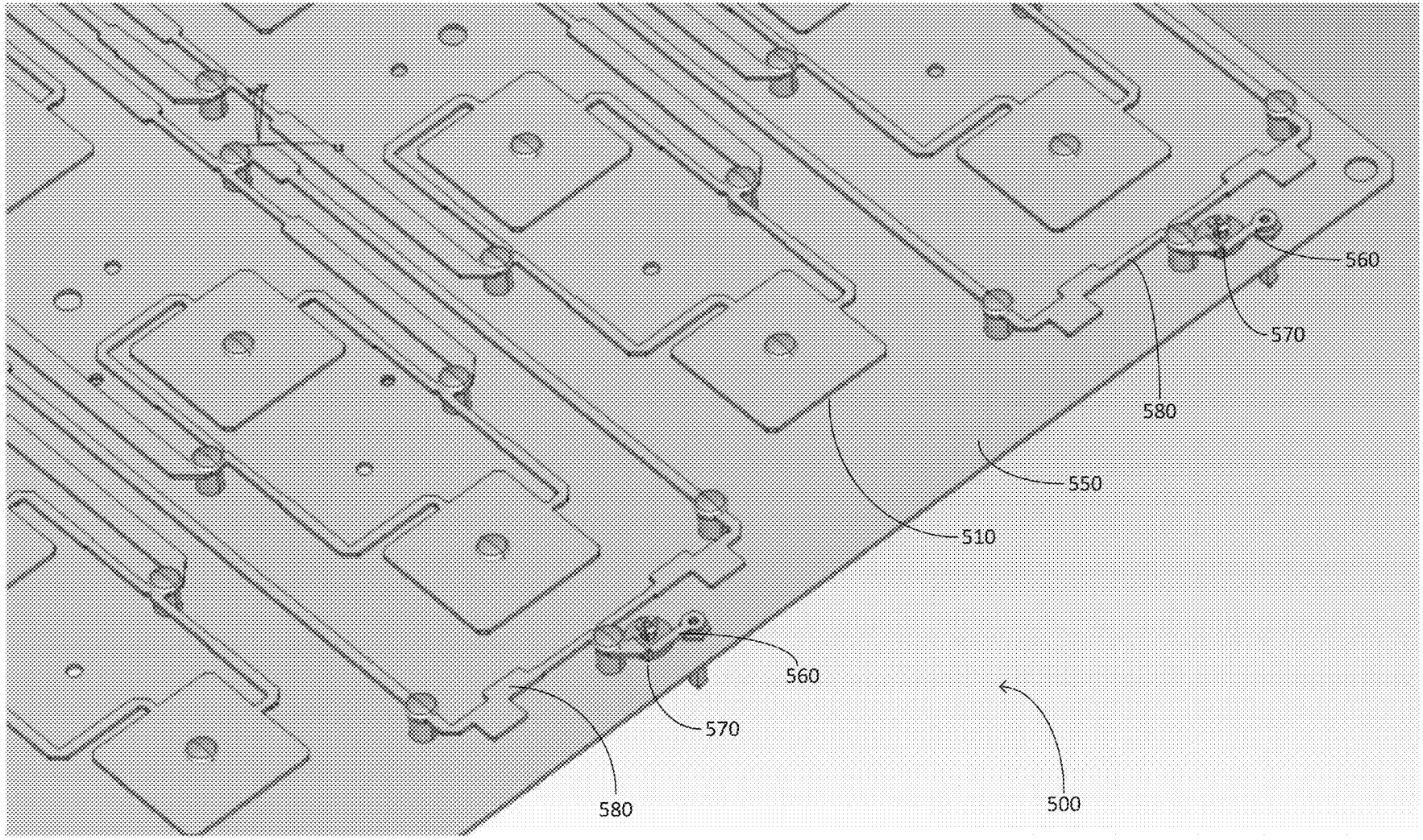
FIG. 24 is a zoomed in perspective top view at one side of the antenna array of FIG. 22.
Figure 25:
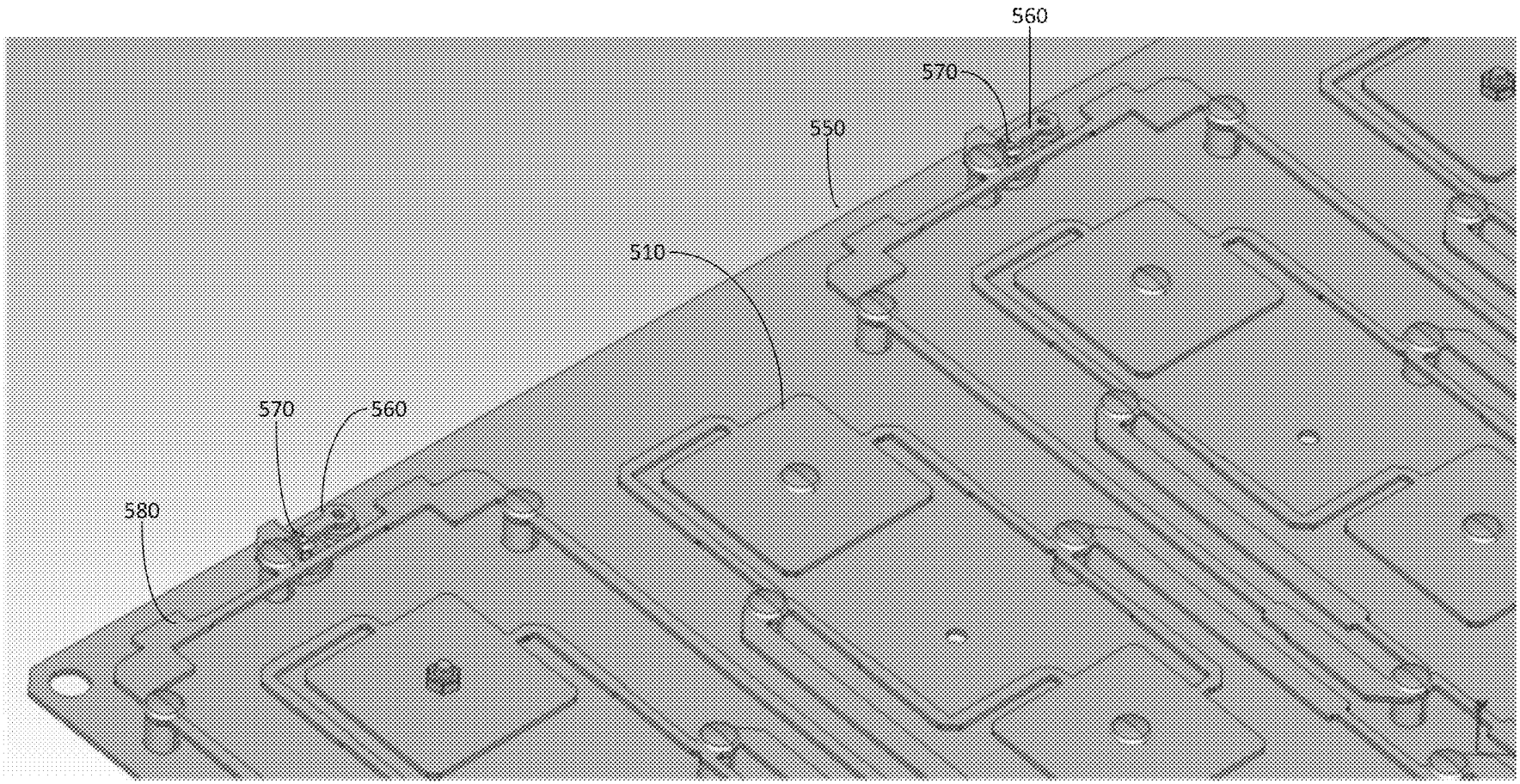
FIG. 25 is a zoomed in perspective top view at another side of the antenna array of FIG. 22.
Figure 26:
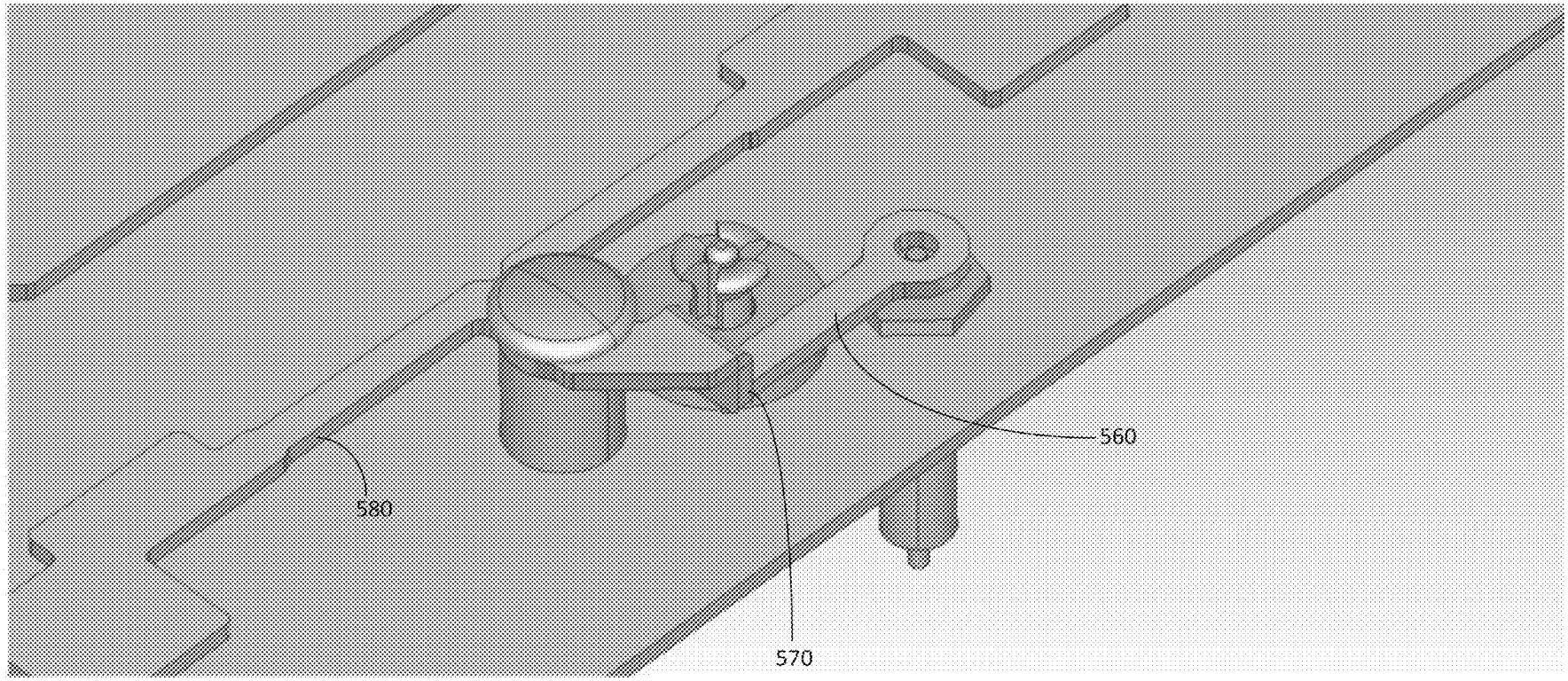
FIG. 26 is a zoomed in perspective view of a vertical impedance matching bridge of the antenna array of FIG. 22.

Referring to FIGS. 6, 7 and 9, the antenna array 100 has a 3D microstrip line feeding network 30, 40 using air as a dielectric above the ground plane 50. The overall height of the 3D microstrip line feeding network 30, 40 provides an ultra thin profile with only 8% of operating wavelength and is very lightweight. An ultra thin profile is considered to be less than 10% of operating wavelength. The antenna array 100 provides a better radiation pattern or antenna pattern, and gain through a 3D microstrip line feeding network 30, 40. Referring to FIG. 17, the improved radiation pattern at 3400 MHz is depicted. Referring to FIG. 18, the improved radiation pattern at 3500 MHz is depicted. Referring to FIG. 19, the improved radiation pattern at 3600 MHz is depicted. Referring to FIG. 20, the improved radiation pattern at 3700 MHz is depicted. Referring to FIG. 21, the improved radiation pattern at 3800 MHz is depicted.

The width of microstrip line feeding network 180, 190 on the upper layer 80 is reduced. For example, the width of the upper layer 80 may be about 2 mm, compared to a conventional 6 mm width for traditional impedance matching with an arbitrary characteristic impedance matching network (e.g. the characteristic impedance can be any value) instead of a traditional 50 Ohm matching network, to provide good impedance matching for the patch antenna array 100 and also reduces the side lobes of the radiation pattern to a very low level. This effectively increases the gain of the patch antenna array 100.

Referring to FIGS. 8, and 10 to 13, the antenna array 100 has a 3D microstrip line feeding network 30, 40 has two layers 60, 80 that are connected by a vertical matching bridge 70 to deliver good matching bandwidth through an arbitrary characteristic impedance matching network on the upper layer 80. The vertical matching bridge 70 functions as a transformer to deliver impedance matching at the output of the antenna. 50 Ohm is preferred but other values are possible. The narrow width of the microstrip line of the upper layer 80 reduces the SLL and therefore increases the forward gain of the antenna array 100. In order to provide a low profile antenna, the length of the vertical matching bridge 70 is less than the length of a conventional two-dimensional quarter wave transformer by designing and arranging part of the quarter wavelength to both the top and lower layers 60, 80 of the 3D microstrip line feeding network 30, 40.

At the top of the vertical matching bridge 70, a through hole 71 is provided to assist with assembly during manufacture.

The antenna array 100 has a cost effective design where all the radiating patch antenna elements 10 and microstrip lines of the 3D microstrip line feed network are engineered in metal, for example, aluminium. This makes the antenna array 100 inexpensive to manufacture because it does not require complex manufacturing techniques. The upper layer 80 of the 3D microstrip line feeding network 30, 40 and the antenna elements 10 can be manufactured using an injection molding process. The vertical bridge 70 and the lower layer 60 can be connected to the upper layer 80. The present invention may be made from other materials that have been described including: RF PCB, FR4, brass, LDS (Laser Direct Structuring) or PDS (Printing Direct Structuring). The patch antenna elements 10 and the 3D microstrip line feeding network 30, 40 can be made from a metallic alloy.

Figure 14:
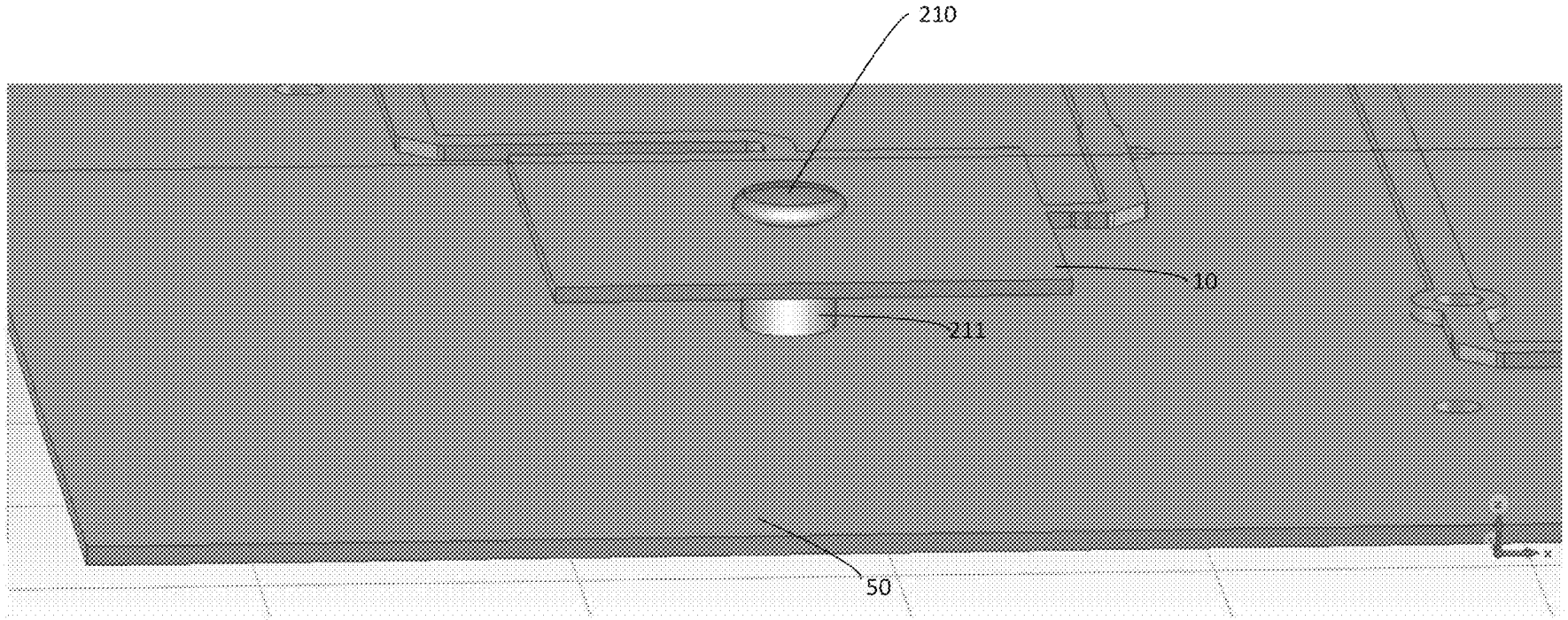
FIG. 14 is a perspective view from above of an antenna element of FIG. 3.
Figure 15:
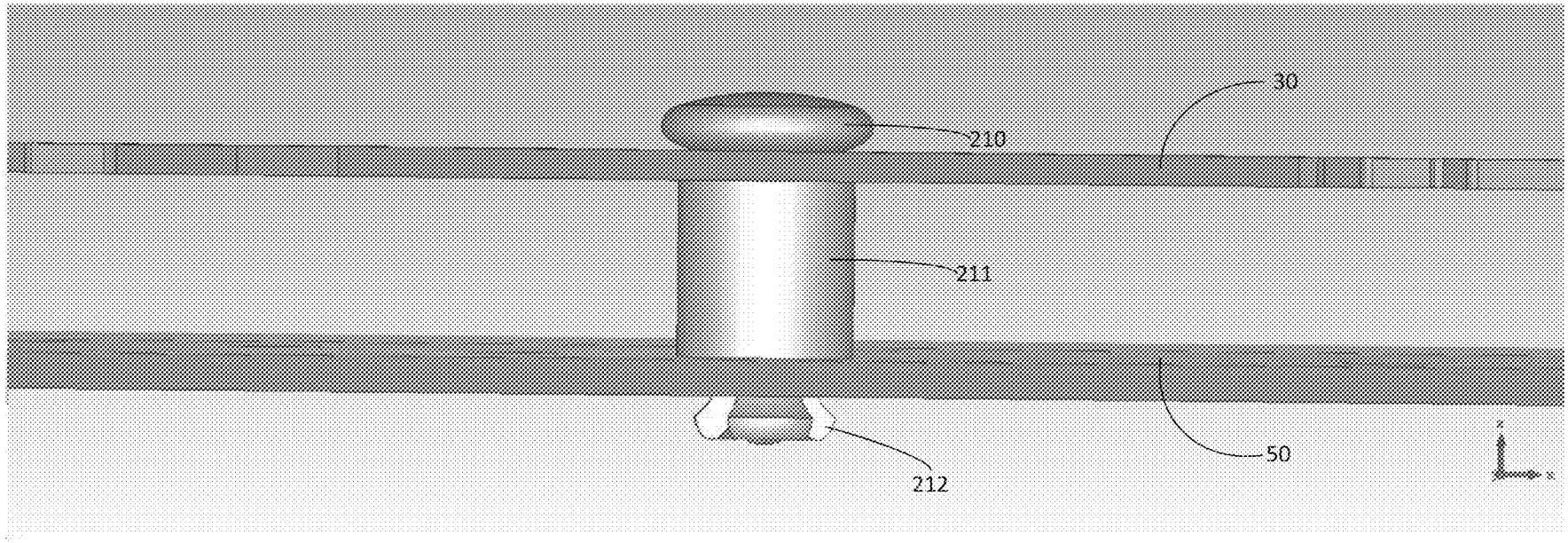
FIG. 15 is a zoomed in side view of the antenna array of FIG. 1.
Figure 16:
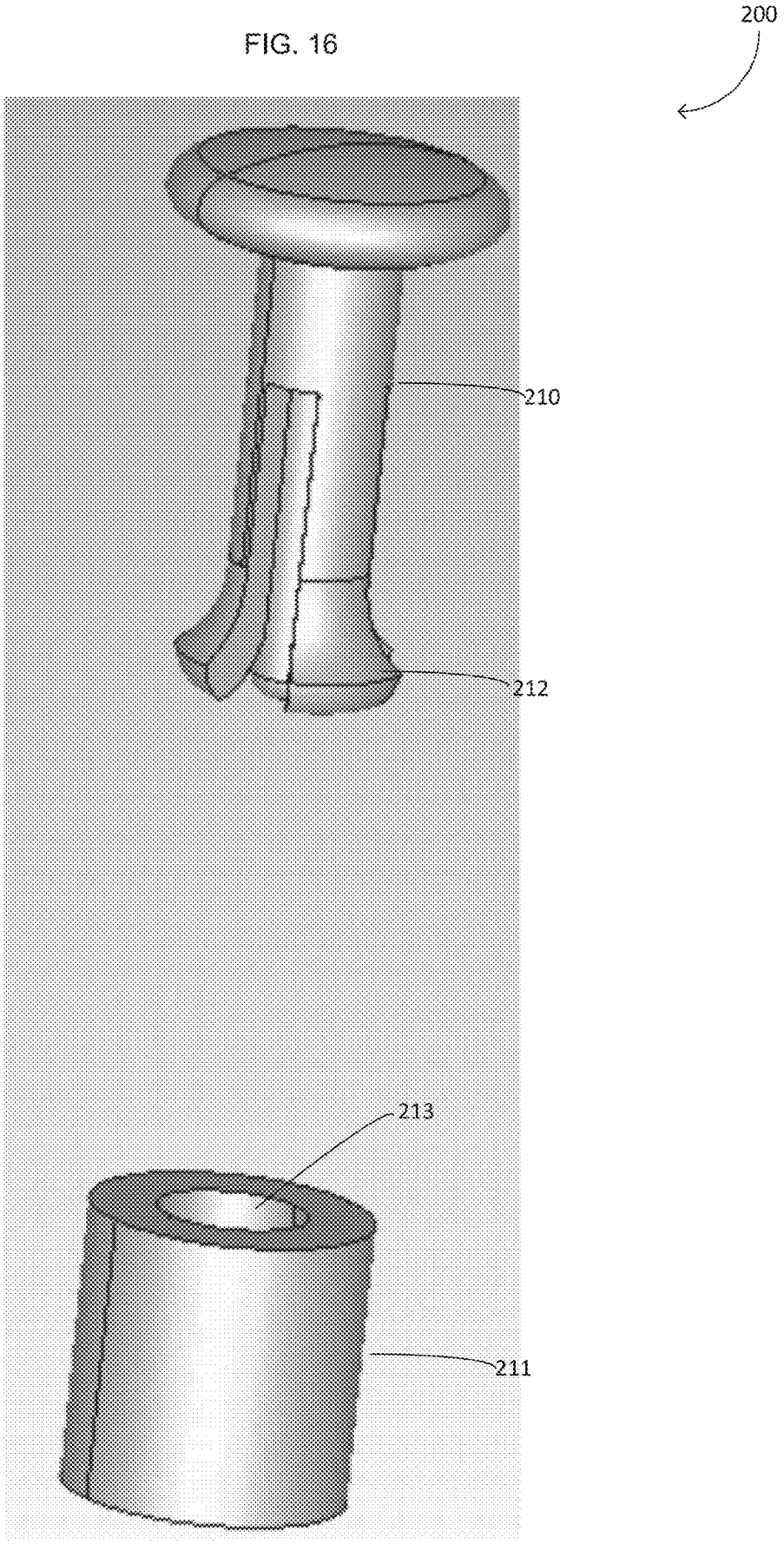
FIG. 16 is a zoomed in view of a non-metallic rivet and non-metallic spacer used to secure the antenna elements and 3D microstrip line feeding network to the ground plane.

Referring to FIGS. 14 to 16, a plurality of non-metallic rivets 210 are insertable through non-metallic spacers 211 to secure the 3D microstrip line feeding network 30, 40 above the ground plane 50 at a fixed height. A series of holes 51 in the 3D microstrip line feeding network 30, 40 and ground plane 50 enables the rivets 210 to pass through. The patch antenna element 10 is also secured to the ground plane 50 using a similar non-metallic rivet 210. The rivet 210 has a split pin design at its base where the legs 212 of the rivet flare outwardly. A centrally located through-hole 213 in the patch antenna element 10 enables the rivet 210 to pass through. A dielectric material can be used for the rivet 210 and spacer 211, for example, plastic.

Referring to FIGS. 22 to 26, in another example, a 4×4 MIMO dual polarized array antenna 500 is provided. Compared to the specific 2×2 MIMO dual polarized array antenna described earlier which is based on a 2 port+45° panel antenna array with 3D microstrip line feeding network, the 3D microstrip line feeding network 600, 700, 800, 900 for the 4×4 MIMO dual polarized array antenna further splits the 2 port output to a total of 4 ports. The 3D microstrip line feeding network for both the 2×2 MIMO and 4×4 MIMO use an arbitrary characteristic impedance.

The upper layer 580 of the 3D microstrip line feeding network 600, 700, 800, 900 is positioned to lie in the same plane as the height of the patch antenna element 510. In other words, the top surface of the upper layer 580 of the 3D microstrip line feeding network 600, 700, 800, 900 is in the same horizontal plane as the top surface of the patch antenna elements 510. The lower layer 560 of the 3D microstrip line feeding network 600, 700, 800, 900 is positioned between the upper layer 580 and the ground plane 550. There are four (4) vertical impedance matching bridges 570 between the upper layer 580 and the lower layer 560 of the 3D microstrip line feeding network 600, 700, 800, 900.

The four vertical matching bridges 570 function similarly to the previously described vertical matching bridges 70 of the 2×2 MIMO dual polarized array antenna 100. The 3D microstrip line feeding network 600, 700, 800, 900 of the 4×4 MIMO antenna provides an effective way to reduce the side lobes and increase the antenna forward gain. The vertical matching bridges 70, 570 of the 2×2 MIMO antenna and 4×4 MIMO antenna perform a similar function as the critical transformer. For the 2×2 MIMO antenna, the vertical matching bridges 70 are performing the function of a transformer of the top layer impedance which comes from a four stage combining network with sixteen patch elements 10. For the 4×4 MIMO antenna, the vertical matching bridges 570 are performing the function of a transformer of the top layer impedance which comes from a three stage combining network with eight patch elements 510. The physical dimension of the vertical matching bridges 70, 570 may differ slightly dependent on the actual combining network and the number of patch elements 10, 510 included in the particular antenna 100, 500.

One difference between the 4×4 MIMO dual polarized array antenna 500 and the 2×2 MIMO antenna, is that the last combiner stage (fourth-stage combiner 34 as seen in the 2×2 MIMO) is removed from the microstrip line feeding network 30, 40 for the 4×4 MIMO dual polarized array antenna 500. Thus, the 4×4 MIMO dual polarized array antenna 500 has three (3) stages of a combiner for each microstrip line 600, 700, 800, 900. The typical combining of the microstrip line 600 is there are four (4) first-stage combiners 601 where each first-stage combiner 601 is connected to antenna elements 510 in co-polarization and the second-stage combiner 602 respectively. There are two (2) second-stage combiners 602 where each second-stage combiner 602 is connected to both a first-stage combiner 601 and a third-stage combiner 603 to deliver a wideband combiner 600. A similar wideband combining also applies for the other microstrip lines 700, 800, 900. The microstrip lines 600, 700, 800, 900 of a combiner are designed in cascade ultra-wideband. Depending on a particular scenario, the choice of removing the last combiner stage in the 4×4 MIMO antenna compared to retaining the last combiner stage in the 2×2 MIMO antenna may be to provide a method for multiplying the capacity of a radio link using multiple transmit and receive antennas to exploit multipath propagation. Another advantage is that the 2×2 MIMO antenna is designed to be easily modified into a 4×4 MIMO antenna (should circumstance require) with further splitting of the final stage combiner (e.g. the fourth stage combiner). The 4×4 MIMO antenna has another observable difference compared to the 2×2 MIMO antenna which is that in the same antenna form factor, the 4×4 MIMO antenna will have a 3 dB reduction on the gain, compared with the 2×2 MIMO antenna.

A GPS antenna 590 may be added to the 4×4 MIMO dual polarized array antenna 500. The GPS antenna 590 receives a Global Positioning System satellite signal to identify the location of the 4×4 MIMO dual polarized array antenna 500.

The combination of the multistage combiner and the vertical matching impedance bridges of the MIMO antennas (2×2 and 4×4) described enables a physically compact antenna footprint, an ultra thin profile, a reduction in SLL, improvement to antenna gain and easier assembly and manufacturability.

Unless specified to the contrary, any and all components herein described are understood to be capable of being manufactured and, as such, may be manufactured together or separately.

Moreover, in interpreting the disclosure, all terms should be interpreted in the broadest reasonable manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The subject headings used in the detailed description are included only for the ease of reference of the reader and should not be used to limit the subject matter found throughout the disclosure or the claims. The subject headings should not be used in construing the scope of the claims or the claim limitations.

Although the technology herein has been described with reference to particular examples, it is to be understood that these examples are merely illustrative of the principles and applications of the technology. In some instances, the terminology and symbols may imply specific details that are not required to practice the technology. For example, although the terms "first" and "second" may be used, unless otherwise specified, they are not intended to indicate any order but may be utilised to distinguish between distinct elements.

It is therefore to be understood that numerous modifications may be made to the illustrative examples and that other arrangements may be devised without departing from the spirit and scope of the technology.

What is claimed is:

1. An antenna assembly for transmitting or receiving radio waves, comprising:

at least one patch antenna element;

a ground plane;

a three-dimensional (3D) microstrip line feeding network physically connected to and configured to feed the at least one patch antenna element for operation in dual polarisation, the 3D microstrip line feeding network comprising microstrips in an upper layer having a predetermined minimal width and located in a common plane and microstrips in a lower layer, the upper layer being more remote from the ground plane than the lower layer; and air in a space separating the at least one patch antenna element from the ground plane and in a space separating the upper and lower layers of the 3D microstrip line feeding network and its microstrips;

wherein a first air gap is provided between the at least one patch antenna element and the ground plane, a second air gap is provided between the upper layer of the 3D microstrip line feeding network and the ground plane, and a third air gap is provided between the lower layer of the 3D microstrip line feeding network and the ground plane, wherein the three air gaps are related to impedance matching when the ground plane is referenced.

2. The antenna assembly according to claim 1, wherein the 3D microstrip line feeding network further comprises at least one impedance-matching bridge extending between and connecting the upper layer to the lower layer, the at least one impedance-matching bridge configured to operate as a transformer of the upper layer of the 3D microstrip line feeding network for reducing side lobe level (SLL).

3. The antenna assembly according to claim 2, wherein a longitudinal axis of the impedance-matching bridge is perpendicular to the ground plane.

4. The antenna assembly according to claim 1, wherein the upper layer of the 3D microstrip line feeding network is located at a same distance above the ground plane as is the at least one patch antenna element.

5. The antenna assembly according to claim 1, wherein the lower layer of the 3D microstrip line feeding network is positioned at approximately a midpoint between the upper layer of the 3D microstrip line feeding network and the ground plane.

6. The antenna assembly according to claim 1, wherein the at least one patch antenna element has a rectangular shape.

7. The antenna assembly according to claim 1, comprising a plurality of patch antenna elements.

8. The antenna assembly according to claim 7, wherein the upper layer of the 3D microstrip line feeding network comprises a consecutive series of branching members configured to operate as a combiner for each polarization feed of the plurality of patch antenna elements.

9. The antenna assembly according to claim 1, wherein the lower layer of the 3D microstrip line feeding network comprises rectangular microstrips having a length that is approximately equal to half the width of the at least one patch antenna element.

10. The antenna assembly according to claim 9, wherein the lower layer of the 3D microstrip line feeding network has a through-hole located at each terminal end of the lower layer for connection to a line wire or cable.

11. The antenna assembly according to claim 3, wherein a length in direction of the longitudinal axis of the impedance-matching bridge is less than a length of an equivalent two-dimensional quarter wave transformer by designing and arranging part of the quarter wavelength to both the upper and lower layers of the 3D microstrip line feeding network, thereby providing a lower-height profile antenna.

12. The antenna assembly according to claim 2, wherein there is an even number of impedance-matching bridges.

13. The antenna assembly according to claim 12, wherein the impedance-matching bridges are positioned near opposite sides of the ground plane.

14. The antenna assembly according to claim 2, wherein the at least one impedance-matching bridge has a length of about 20 mm for a quarter-wavelength of 3600 MHz.

15. The antenna assembly according to claim 1, further comprising a plurality of non-metallic rivets and hollow non-metallic spacers configured to secure the upper layer above the ground plane at a predetermined height, wherein the hollow non-metallic spacers are positioned between the upper layer and the ground plane and the non-metallic rivets pass through through-holes in the upper layer, the hollow non-metallic spacers and the ground plane.

16. The antenna assembly according to claim 15, wherein the non-metallic rivets are push-in rivets with a bevelled head.

17. A 3D microstrip line feeding network configured to feed at least one patch antenna element for operation in dual polarisation, comprising:

an upper layer of microstrips extending in a common plane with the at least one patch antenna element, air forming a sole dielectric between the microstrips of the upper layer as well as between the upper layer and the at least one patch antenna element, a lower layer of microstrips extending in a plane offset from the common plane of the upper layer, air forming a sole dielectric between the lower and upper layers, wherein the microstrips in the upper layer and the microstrips in the lower layer physically connect to the at least one patch antenna element for operation in dual polarisation; and at least one impedance-matching bridge extending through an air gap and connecting the upper layer to the lower layer of microstrips, the at least one impedance-matching bridge configured to operate as a transformer of a upper layer of the 3D microstrip line feeding network for reducing side lobe level (SLL) when the at least one patch antenna is operated through the 3D microstrip line feeding network.

18. The antenna assembly according to claim 2, wherein the upper layer has a first predetermined geometric dimension determining a first characteristic impedance ($Z_1$), the at least one impedance-matching bridge has a second predetermined geometric dimension determining a second characteristic impedance ($Z_2$), and the lower layer has a third predetermined geometric dimension determining a third characteristic impedance ($Z_3$); and wherein the first characteristic impedance ($Z_1$) multiplied by the third characteristic impedance ($Z_3$) is equal to the square of the second characteristic impedance ($Z_2$).

19. The antenna assembly according to claim 18, wherein the antenna assembly is a 2×2 Multiple In Multiple Out (MIMO) antenna or 4×4 Multiple In Multiple Out (MIMO) antenna.

20. The antenna assembly according to claim 1, wherein the antenna assembly is a 2×2 Multiple In Multiple Out (MIMO) antenna or 4×4 Multiple In Multiple Out (MIMO) antenna.

* * * * *